US008161664B1

(12) United States Patent
Dawson

(10) Patent No.: US 8,161,664 B1
(45) **Date of Patent: *Apr. 24, 2012**

(54) PANT-LEG-COVERS FOR MODIFIED FOOTWEAR, CONVENTIONAL FOOTWEAR, AND OTHER FOOT-RECEIVING APPARATUSES

(76) Inventor: Andrew Curran Dawson, Oxford, MI (US)

( * ) Notice: Subject to any disclaimer, the term of this patent is extended or adjusted under 35 U.S.C. 154(b) by 1083 days.

This patent is subject to a terminal disclaimer.

(21) Appl. No.: 11/881,429

(22) Filed: Jul. 27, 2007

Related U.S. Application Data

(63) Continuation-in-part of application No. 10/936,166, filed on Sep. 8, 2004, now Pat. No. 7,441,348.

(51) Int. Cl.
*A43B 23/26* (2006.01)
*A43B 13/14* (2006.01)

(52) U.S. Cl. ..... 36/54; 36/99; D2/902

(58) Field of Classification Search ..... 36/99, 54, 36/100, 101, 132, 136, 902; D2/902
See application file for complete search history.

(56) References Cited

U.S. PATENT DOCUMENTS

| | | | | |
|---|---|---|---|---|
| 3,334,427 | A | 8/1967 | Edwards et al. | |
| 3,601,909 | A | 8/1971 | Amendola | |
| 3,783,534 | A * | 1/1974 | Phillips et al. | 36/54 |
| 4,372,060 | A * | 2/1983 | Adamik | 36/54 |
| 4,377,913 | A * | 3/1983 | Stone | 36/99 |
| 4,697,362 | A | 10/1987 | Wasserman | |
| 4,805,321 | A | 2/1989 | Tonkel | |
| D311,446 | S | 10/1990 | Merritt | |
| 5,209,000 | A | 5/1993 | Rowland et al. | |
| 5,239,450 | A | 8/1993 | Wall | |
| 5,452,269 | A | 9/1995 | Cherdak | |
| 5,457,900 | A | 10/1995 | Roy et al. | |
| 5,459,947 | A | 10/1995 | Lasher | |
| 5,461,188 | A | 10/1995 | Drago et al. | |
| 5,566,477 | A | 10/1996 | Mathis et al. | |
| 5,659,979 | A | 8/1997 | Sileo | |
| 5,661,916 | A | 9/1997 | Huang | |
| 5,673,499 | A | 10/1997 | Attilieni | |

(Continued)

FOREIGN PATENT DOCUMENTS

| | | |
|---|---|---|
| WO | WO 00/26890 | 5/2000 |

(Continued)

OTHER PUBLICATIONS

Adidas Micropacer 1984 Running Shoe: http://www.sneakerfiles.com/adidas/adidas-micro-pacer-micropacer/.

(Continued)

*Primary Examiner* — Jila Mohandesi

(57) ABSTRACT

Improved foot-receiving apparatuses that may include: a housing somewhat defining an interior (16) for receiving a foot, and having an external periphery; and at least one Pant-Leg-Cover (XX1) disposed substantially outside of the external periphery of the housing, where the Pant-Leg-Cover (XX1) extends upward from a fixable lower portion (A1) joined to the housing to a free upper portion (D1) movable relative to the housing, where a pant leg (99) can be at least accommodated, secured, and utilized between the housing and the Pant-Leg-Cover. The consumer may have the option to freely join or un-join the Pant-Leg-Cover with the housing to at least change the aesthetic appearance of the apparatus, e.g. depending on personal preference. This specification describes numerous embodiments that will create a sustainable competitive advantage for a select corporation.

16 Claims, 20 Drawing Sheets

U.S. PATENT DOCUMENTS

| | | | | |
|---|---|---|---|---|
| D385,998 | S | 11/1997 | Clegg | |
| 5,813,148 | A | 9/1998 | Guerra | |
| 5,845,422 | A | 12/1998 | Valteau, III | |
| 5,894,686 | A | 4/1999 | Parker et al. | |
| 6,000,111 | A | 12/1999 | Deskins et al. | |
| D433,212 | S | 11/2000 | Morle | |
| 6,212,797 | B1 | 4/2001 | Merry et al. | |
| 6,278,378 | B1 | 8/2001 | Feiner et al. | |
| 6,321,466 | B1 | 11/2001 | Bordin et al. | |
| 6,397,497 | B1 * | 6/2002 | McAtee | 36/54 |
| 6,574,887 | B2 | 6/2003 | Jones et al. | |
| 6,578,291 | B2 | 6/2003 | Hirsch et al. | |
| 6,829,847 | B2 | 12/2004 | O'Shea et al. | |
| 6,874,256 | B2 | 4/2005 | Delgatty | |
| 6,898,873 | B2 | 5/2005 | Schenone | |
| 6,964,493 | B1 | 11/2005 | Whitlock | |
| 6,971,192 | B2 * | 12/2005 | Shepherd | 36/54 |
| 7,038,398 | B1 | 5/2006 | Lys et al. | |
| 7,059,070 | B2 | 6/2006 | Omstead et al. | |
| 7,117,616 | B2 | 10/2006 | Hull | |
| D555,333 | S | 11/2007 | Riebesell | |
| 2002/0029494 | A1 * | 3/2002 | Small | 36/54 |
| 2004/0187184 | A1 | 9/2004 | Rubin et al. | |
| 2004/0255490 | A1 | 12/2004 | Wan et al. | |
| 2006/0112599 | A1 | 6/2006 | Braynock et al. | |
| 2008/0078104 | A1 | 4/2008 | Riebesell | |

FOREIGN PATENT DOCUMENTS

| | | |
|---|---|---|
| WO | WO 2006/042225 | 4/2006 |

OTHER PUBLICATIONS

Attached are eight close-up pictures of the 1984 Micropacer.

More information on the Micropacer of 1984: http://articles.latimes.com/1987-04-21/business/fi-196_1_adidas-shoe.

Converse Double Tongue Shoe http://images.google.com/images?hl=en&source=hp&q=converse+double+tongue&gbv=2&aq=f&oqi=&aqi=g10.

Google: Converse Double Tongue Information and pictures are easily available.

1989 Reebok Advertisement: Advertismement features Paula Abdul in Reebok Shoes; the advertisement's title line: "Millions of Girls Want to be in Her Shoes."

* cited by examiner

PANT-LEG-COVERS FOR MODIFIED FOOTWEAR, CONVENTIONAL FOOTWEAR, AND OTHER FOOT-RECEIVING APPARATUSES

CROSS REFERENCE TO RELATED APPLICATIONS

THIS APPLICATION IS A CONTINUATION-IN PART TO U.S. application Ser. No. 10/936,166 filed Sep. 8, 2004 now U.S. Pat. No. 7,441,348.

FIELD OF THE INVENTION

The present invention relates to modified footwear, conventional footwear, and other foot-receiving apparatuses, and especially a foot-receiving apparatus having at least the ability to customize and enhance its appearance.

BACKGROUND OF THE INVENTION

In leisure shoes, athletic shoes or sneakers, and many sports boots the ability to have functional, safe, comfortable, customizable, and expressive footwear is particularly important for successful marketing of footwear. Over the years, footwear and other foot-receiving apparatuses have become an increasing method for personal expression. Inventors, investors, and corporations have been feverishly trying to discover the footwear that their youth target market will love. In the past decade, numerous patents have been issued for functional, safe comfortable, customizable, and expressive portions of shoes. None of these ideas have solved all of the following problems.

Many sports and music fans enjoy supporting their favorite sports teams or music artists by wearing clothing decorated with the team's/artist's logo, team's/artist's name, etc. Foot-receiving apparatuses are commercially available that depict such logos and names for consumers. However, if a fan wishes to display different logos or names, then a corresponding number of foot-receiving apparatuses are needed. In the same manner, a fan who wishes to display the team or artist logo with different styles of foot-receiving apparatuses would also require a corresponding number of foot-receiving apparatuses. This can be very costly and is not the only problem.

Current expressive portions of footwear get covered not only by lace-securing members, but also by long, loose-fitted pant legs. Decorative attachments used to customize footwear are also are covered by long, loose-fitted pant legs. Thus, consumers are forced to bunch-up or jam-up their pant legs behind the expressive portions on their footwear. This action is necessary for consumers in order to 'show off' or express themselves, the best they can, using their footwear. From a perspective within this target market, jamming-up our pant legs is extremely uncomfortable. The jammed-up pant leg rubs between our ankle and portions of our footwear. This proves to be extremely inconvenient, uncomfortable, and looks hideous. Moreover, after some walking or movement, our pant legs return to covering the expressive portions on our footwear, we are inconvenienced, and left with little options. Current expressive portions for footwear are not built to accommodate, secure, and utilize long, loose-fitted pant legs.

Additionally, long, loose-fitted pant legs are fashionable for a select target market. Yet, the fashionable pant legs have caused consumers an increasing number of problems (some additional to those mentioned above). Problems from pant legs include, but are not limited to: safety hazards (e.g. when riding a bicycle or scooter), comfort (worn in the wind), keeping the pant leg clean, and in one piece (keeping it above the bottom sole of the footwear), and fashion (pant legs and closure devices cover the expressive portions on footwear).

Most recently, electronic components have been added to footwear. Manufacturers are putting electronic components and visual displays on every type of object known to man. The mindset seems to be, if it has a visual display, it will sell. As a result, patents exist where visual displays are added onto furniture, shirts, pants, footwear, etc. However, this broad mindset does not take into account the many disadvantages associated with incorporating visual displays with footwear.

Similar to other customizable portions of footwear, the current visual displays on footwear include disadvantages. Disadvantages of current visual displays on footwear are, but not limited to, the following:

(A) The current visual displays are only and exactly that, visual displays. These displays only inform the consumer through a single human sense, sight. This limits the consumer's accessibility to information. For example, a video that requires sound, using a current video display, has little or no benefit to the consumer and others. Current visual displays do not include synchronized audio speakers.

(B) Current visual displays on footwear cannot be quickly, efficiently, and conveniently removed or interchanged from the footwear. This has numerous associated disadvantages; many will be discussed later in this specification.

(C) Current visual displays on footwear cannot be used as a hand-held device.

(D) Current footwear including visual displays cannot take their own pictures to be displayed on the footwear.

(E) Current footwear including visual displays cannot take their own video to be displayed on the footwear.

(F) Current footwear including visual displays cannot appear to be conventional footwear.

(G) When the consumer is wearing the footwear including current visual displays, the displays are always susceptible to unexpected environmental factors (e.g. rain, snow, dirt, liquids, etc.).

(H) The visual displays can only be viewed from on the footwear. Therefore, if the consumer wants to get a closer look at their visual display, they have to either take off their footwear or bring their foot closer to their eyes. This is inconvenient because the footwear can be dirty, oddly shaped, smelly, etc.

(I) The visual displays also do not provide the consumer with a customizable border to the visual display. This limits the marketability of the footwear.

(J) Current visual displays on footwear are limited to the size, shape, and flexibility of the housing of the footwear.

(K) The visual display is a body-length away from the consumer's eyes. The distance and limited size of the visual display increases strain on the human eye.

(L) Current visual displays on footwear must be made of a flexible, comfortable material. The reason is that the current visual displays are located on the housing of the footwear that directly touches the consumer's foot. This limits the type of visual display available on footwear (e.g. flexibly backed). As a result, this limits a manufacturer's product differentiation.

(M) Current visual displays on footwear do not provide a way to change an angle of the displays. Therefore, the consumer must move their foot in various ways to achieve a desired viewing angle.

(N) Current visual displays on footwear do not have an additional power source.

(O) Current visual displays on footwear do not have an additional memory source.

(P) Additionally, as mentioned above, the long, loose-fitted pant legs of consumers easily cover the visual displays. As a result, the visual displays are neither conveniently nor remotely viewable to the consumer and others.

Accordingly, it would be advantageous to provide foot-receiving apparatuses including at least a Pant-Leg-Cover. The Pant-Leg-Covers would be built to at least substantially accommodate, secure, and utilize the long, loose-fitted pant legs of consumers. As a result, the Pant-Leg-Covers would at least increase consumer safety, convenience, cleanliness, comfort, fashion, options, and personal expression. Moreover, it would be advantageous if the consumer would be able to at least: easily, conveniently, efficiently, and securely include the Pant-Leg-Covers with foot-receiving apparatuses, if so desired; to easily, conveniently, efficiently, and comfortably secure long, loose-fitted pant legs between the housing of the apparatus and the Pant-Leg-Covers, if so desired; to customize the Pant-Leg-Covers, if so desired; to easily, conveniently, and efficiently interchange the Pant-Leg-Covers, if so desired, and/or to easily, conveniently, and efficiently remove the Pant-Leg-Covers, if so desired.

BRIEF SUMMARY

The object of the following embodiments is to overcome the disadvantages of conventional footwear, modified footwear, and other foot-receiving apparatuses described herein above. Furthermore, relating to the present invention, the object of its embodiments are to at least increase consumer comfort, convenience, fashion, personal expression, and safety.

The object of the following embodiments is to provide portions of foot-receiving apparatuses that are more readily visible to the consumer, other consumers, and the surrounding environment. Increasing the visibility of expressive portions on a foot-receiving apparatus increases the marketability of the apparatus. The following embodiments relate to increasing the visibility of interchangeable expressive portions, affixed expressive portions, and unique expressive closure devices.

In accordance with one embodiment, a foot-receiving apparatus, relating to at least some examples, can consist of, for example, the following: a housing somewhat defining an interior for receiving a foot, and having an external periphery and at least one engagement feature; and at least one interchangeable, Pant-Leg-Cover disposed substantially outside of the external periphery of the housing, where the Pant-Leg-Cover extends upward from a fixable lower portion joined to the housing to a free upper portion movable relative to the housing.

The following embodiments are great assets, due to the fact that they increase the visibility and marketability of foot-receiving apparatuses. The increased marketability aspects will appeal to more consumers, leading to increased sales and revenues. Proper strategy combined with increased revenues equates to a higher profit margin, which expands shareholder value.

BRIEF DESCRIPTION OF THE DRAWINGS

The invention as described thus far and other objects, features, and advantages of the present invention will be more readily apparent to those skilled in the art and more fully understood from the following detailed description, taken in association with the appended drawings, in which.

DETAILED DESCRIPTION OF SOME EMBODIMENTS

Figure 1:
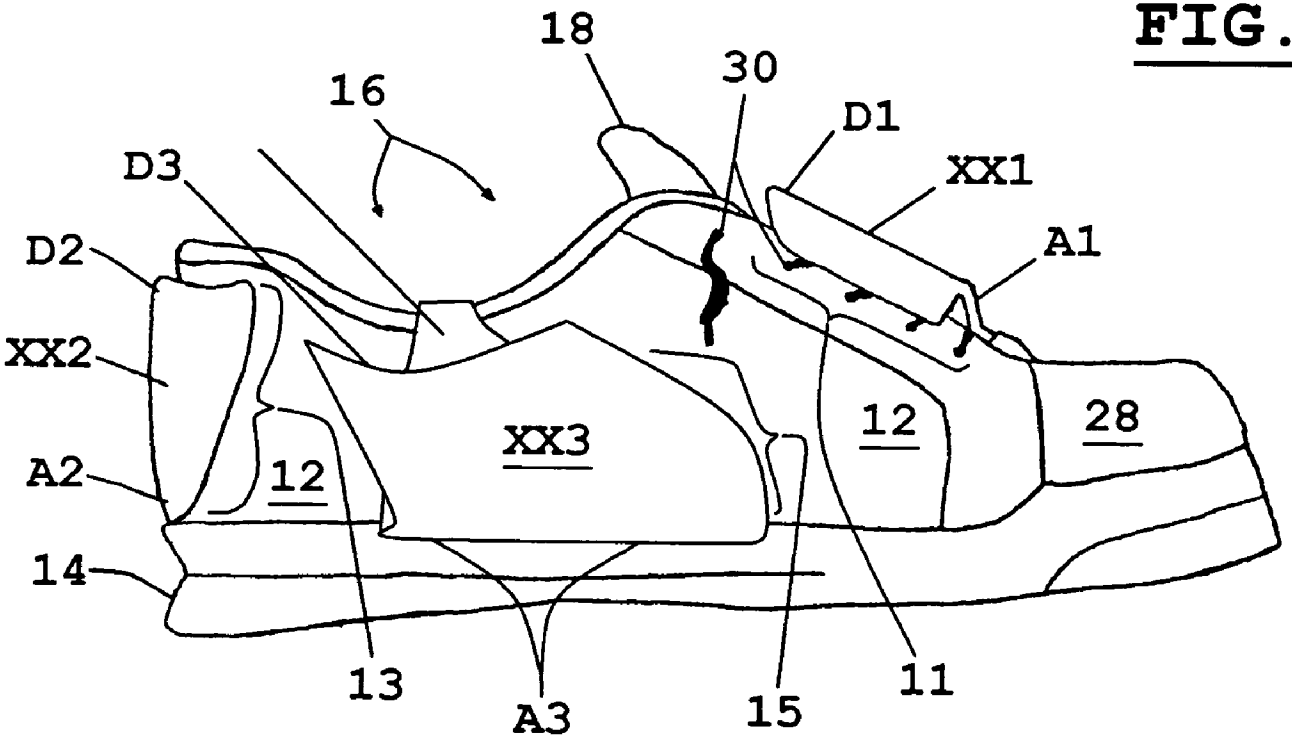
FIG. 1 is a right side view of a foot-receiving apparatus that includes three Pant-Leg-Covers (PLC's).

In association with the appended drawings, specific embodiments of the invention are described in detail below. To assist the reader, this specification is separated into multiple subsections, as follows: Terms; General Description of Foot-Receiving Apparatuses and Methods in Accordance with Embodiments of the Present Invention; Specific Embodiments; and Conclusion.

A. TERMS

The following terms are used in this specification. Unless otherwise noted or clear from the context, the terms' meanings are provided as follows:

"Footwear" means any type of wearing apparel for the feet, and this term includes, but is not limited to: all types of shoes, boots, sneakers, sandals, slippers, thongs, flip-flops, mules, scuffs, clogs, sport-specific shoes or boots (such as snowboarding boots, ski boots, golf shoes, running shoes, basketball shoes, shoes with cleats, etcetera, etcetera), and the like; including any of the above terms visible in programs created through virtually realistic program modules operated by consumers (explained later).

"Foot-receiving apparatus" means any apparatus into which a user or consumer places at least some portion of his or her foot. In addition to all types of footwear (described above), foot receiving apparatuses include, but are not limited to: bindings and other devices for securing feet in snowboards, snowshoes, wakeboards, snow skis, water skis, (virtual or physical), and the like; bindings clips, or other apparatuses for securing feet in pedals for use with bicycles, exercise bikes, games, equipment, (virtual and physical) and the like; bindings, clips, or other apparatuses for receiving feet during the playing of interactive games or sports (virtual or physical), and the like; bindings, clips, or other apparatuses for receiving feet visible in programs created through virtually realistic program modules played by consumers.

"Closure Device" means any system or arrangement used to at least partially secure the consumer's foot in the foot-receiving apparatuses, which includes the following elements and possible combination of elements, but is not limited to: straps, laces, tongues, buckles, hook and loop fasteners, ratchet-mechanisms, elastic members, clips, zippers, and the like.

"Pant leg" means any type of long pant leg on a full-length pair of pants, jeans, trousers, warm-ups, snow pants, rain pants, wet suits, and the like.

"Housing" means a compartment member composed of, but not limited to the following elements and combination of elements for receiving a foot: a sole member, upper member, tongue, closure device, and other possible external portions of foot-receiving apparatuses.

"Fastener arrangements" (engagement features) means any system or arrangement used to join two objects or portions of objects together, which includes the following elements and possible combination of elements, but is not limited to: nuts, bolts, magnets, clips, ties, knots, hook-and-loop type fasteners, zippers, snaps, and the like.

"Join" means at least one of the following:

A. to bring in contact, connect, or bring or put together
B. to integrally connect two elements
C. to come in contact or union with
D. to engage two elements
E. to keep two elements in close contact with one another
F. to unify "Pant-Leg-Cover" (PLC) (parent application referenced as Expressive-Billboard), means but is not limited to: a portion of a foot-receiving apparatus that is substantially outside the external periphery of the housing and has a fixable lower portion joined to the housing and a free upper portion, where the free upper portion extends upward and has the ability to be free from the housing, leaving a substantial length of space between the free upper portion and housing to at least accommodate, secure, and utilize a pant leg; further a Pant-Leg-Cover is, but not limited to: a portion of a foot-receiving apparatus that is able to express some type of message through color, shape, size, material (e.g. cloth, foam, glass, plastic, metal, spikes, etc.), lighting effects, Copyrights, Trademarks, layers, attachments, positioning, dimensions, and the like; wherein the Pant-Leg-Cover is able to be designed, adapted, and customized to the consumer's unique desires. The Pant-Leg-Cover can take on numerous characteristics for consumers to choose from varying in, but not limited to the following: size, shape, weight, rigidity, functionality, durability, and adaptability.

"Virtual Economy" (or sometimes synthetic economy) is an emergent economy existing in a virtual persistent world, usually in the context of an Internet game. People enter these virtual economies recreationally rather than by necessity; however, some people do interact with them for "real" economic benefit.

B. GENERAL DESCRIPTION OF PANT-LEG-COVERS ON MODIFIED FOOTWEAR, CONVENTIONAL FOOTWEAR, AND OTHER FOOT-RECEIVING APPARATUSES AND METHODS IN ACCORDANCE WITH EMBODIMENTS OF THE PRESENT INVENTION

In general, aspects of the present invention relate to modified footwear, conventional footwear, and other foot-receiving apparatuses that can be freely modified (e.g. by any user) to change the footwear's aesthetic appearance in any desired way. For example, to date, many pieces of footwear have removable portions such as, shoe tongues, vamps, or instep coverings.

Unfortunately, at least the long, loose-fitted pant legs of the consumer cover these expressive portions (shoe tongues, vamps, instep coverings). Not only do pant legs cover these expressive portions, but also closure devices such as lace-securing members can cover them as well. Current expressive portions of footwear do not provide a substantial length of space to accommodate, secure, and utilize long, loose-fitted pant legs. Nor do they provide a place to accommodate closure devices. Accordingly, embodiments of the present invention provide solutions to these disadvantages.

The PLC lies above the consumer's pant leg. Thus, pant legs do not jeopardize the visibility of the Pant-Leg-Cover. In fact, the consumer's pant leg acts as a contrasting background to a Pant-Leg-Cover. As a result, the visibility of the Pant-Leg-Cover increases exponentially. Moreover, the Pant-Leg-Cover, in at least some examples, joins and un-joins with the body of the footwear. Further depicting this example, when the PLC is un-joined, the foot-receiving apparatus can appear to be any conventional footwear. Additionally, when the PLC is joined, the consumer has an additional portion of the footwear that is readily customizable.

The Pant-Leg-Cover has limitless possibilities pertaining to appearance, expression and function. The PLC can take on a variety of shapes, sizes, layers, textures, figures, effects, colors, features, and the like. Most importantly, the PLC provides priceless advertising space on the feet of millions of people around the globe. Consumers can express their favorite brands, rap stars, cartoon characters, rock bands, sports teams, and the like above their pant legs in a comfortable, convenient, and safe manner. Trademarks, Copyrights, and electronic devices also provide possible advertisements for the PLC's.

Consumers can personally detail their PLC's using a variety of 'at home' methods including, but not limited to: patches, embroidery, paints, markers, needles and thread, etc. The consumer can also choose to create their own PLC by completing a few actions. First, they can use software programs or hand-draw their desired design. Second, they can email or upload the design to a company web page. Next, the company's designers will make their vision a reality. The corporation selling the PLC's can simplify the design process. For example, a design program can be offered at the company's website where the consumer can easily, conveniently, and quickly create their own personalized Pant-Leg-Covers.

As technology advances, the market space for consumer products advances. Today, numerous Internet based virtual worlds are existent. The largest virtual world I know of is called Second Life. In these virtual worlds, virtual economies and virtual property exist. The virtual property can be made, used, sold, offered for sale, and even imported. Producers and consumers do benefit economically from the creation, use, sale, and offering of consumer products within these virtual worlds (e.g. Pant-Leg-Covers). Users or consumers of the Internet based programs can actually trade-in their virtual dollars for true currency (e.g. United States Dollars). As a result, it is imperative of the reader to understand that virtually created embodiments are not out of the scope of the present intellectual property.

Specific embodiments of the invention are described in more detail below. Accordingly, it is to be understood that the present invention will be described by the way of illustrations and not limitations.

C. SPECIFIC EMBODIMENTS

The figures referenced in this application illustrate embodiments of foot-receiving apparatuses including conventional and modified footwear and their use in accordance with embodiments of this invention. It should be noted, for some readers, that when the same reference numbers or letters appear in multiple figures; the reference numbers or letters refer to the same parts of the invention throughout the figures. For example, pant leg 99 will be labeled constantly throughout the following figures. If any words seem confusing, please reference the "Terms" section of this specification.

Also note worthy; the figures will begin with a general description and will be followed by guidance for operation. A total of twenty-two figures are present. The first operational section begins after the descriptions of FIGS. 1-6. All of the following figures are merely embodiments of the present invention and should not be construed as limiting.

"FIG. 1—Description of Modified Footwear w/3 Pant-Leg-Covers" is a right side view of a specific embodiment. The embodiment of FIG. 1 has an upper member 12 joined to a sole member 14 in any manner, for example, by adhesives, sewing, and/or any other suitable manner, including conventional manners known in the art. At least the upper member 12, the sole member 14, a foot securing tongue 18, a lace-securing member 30, and a front portion of the upper member 28 form a housing defining an interior 16. The outer surface of the housing is also referred to as an external periphery of the housing. The interior 16 is designed for receiving a consumer's foot. The interior utilizes a closure device (30&18) composed of the lace-securing member 30 and the foot securing tongue 18. The lace-securing members join with a plurality of eyelets and/or other lace joining elements provided in the upper member 12, in a conventional manner known in the art. The closure device holds the consumer's foot in the housing.

In at least some embodiments, the sole member 14 (FIG. 1) can include spikes or cleats, for example, like those conventionally provided on football, soccer, golf, baseball, and/or other footwear. Additionally, the upper member 12 and the sole member 14 can be made of a generally conventional construction as is known in the art, for example, including a conventional closure device or system, cushioning or foot comfort elements, foot support structures/systems, etc. Additionally, the various portions of the housing including at least the upper member 12 and the sole member 14 can be constructed from any suitable or desired materials including conventional materials known and used in the art, such as plastic, leather, polymeric materials, nylon, rubber, and/or other natural or synthetic materials.

The embodiment of FIG. 1 can include one or more closure devices (30&18) for at least partially holding a foot in the interior 16. Any desired closure device can be used without departing from the invention, including conventional closure devices known in the art. Such closure devices can include characteristics of "closure device" found in the "Terms" section of this specification. In this particular illustrated example, the closure device (30&18) uses a conventional manner, known in the art.

The embodiment of FIG. 1 further includes a PLC XX1, a PLC XX2, and a PLC XX3. I presently contemplate that the PLC's be made of a bendable material similar to the material found in a brim of a baseball cap. I believe that this material will hold the contour the footwear well, be relatively lightweight, provide a quality customizable surface, and be a cost effective way production. However, any type of material and combination of materials can be used to compose the PLC's. Each material (composition) will provide its own advantages to the consumer such as, but not limited to variations in: weight, durability, ease of cleaning, functions, flexibility, cost, appearance, comfort, fashion, etc. At least the materials, characteristics, and functions can change without departing from the scope of the invention.

The consumer can personalize or customize their PLC's in any suitable manner including, but not limited to: silkscreen prints, heat transfer images, pens, markers, paint brushes, iron-on patches, needle and thread, and even using electronic displays (discussed later). In addition, other ornamentation (e.g. tassels, metal spikes, mirrors, fringes, 3D figures, shiny objects, spinning/movable objects, bows, etc.) can be used to create unique Pant-Leg-Covers. These ornamentations can be joined to the Pant-Leg-Covers in any suitable manner (e.g. sewing, adhesives, fastener arrangements, etc.).

As illustrated in FIG. 1, PLC XX1 joins to the external periphery of the housing at a fixable lower portion A1. The fixable lower portion A1 includes hidden engagement elements. PLC XX1 is removably joined to the front portion of the upper 28. Furthermore, in this particular embodiment the PLC XX1 lies above the closure device (30&18). However, a portion of the PLC can be positioned beneath the closure device. The PLC XX1 has a free upper portion D1. The free upper portion D1 is capable of being free from the closure device and movable relative to the housing. Thus, the free upper portion is capable of creating a significant separation between the external periphery of the housing and the PLC XX1. This results in a substantial length of space 11 above the fixable lower portion A1. The substantial length of space is capable of at least accommodating, securing, and utilizing a long, loose fitted pant leg between PLC XX1 and the housing.

As mentioned, "FIG. 1—Modified Footwear w/3 Pant-Leg-Covers" further includes two additional Pant-Leg-Covers: the PLC XX2, and the PLC XX3. The PLC XX2 is located on the heel portion of the embodiment. PLC XX2 includes a fixable lower portion A2 and a free upper portion D2. In this particular embodiment, the PLC XX2 is fixedly joined to the upper member 12 at the fixable lower portion A2. The free upper portion D2 is capable of being free of the upper member 12 and movable relative to the housing. Furthermore, the free upper portion D2 is capable of creating a considerable separation between the external periphery of the housing and the Pant-Leg-Cover XX2. This results in a substantial length of space 13 above the fixable lower portion A2. The substantial length of space is capable of at least accommodating, securing, and utilizing a long, loose fitted pant leg between PLC XX2 and the housing.

Furthermore, PLC XX3 is located on the outboard side of the embodiment of FIG. 1. In this particular embodiment, PLC XX3 includes a fixable lower portion A3 and a free upper portion D3. PLC XX3 is removably joined to the upper member 12 at a unique location. The unique location will be clearly described in "FIG. 6—Engagement of Pant-Leg-Cover XX3" of the appended drawings. However, the PLC XX3 is similar to the other Pant-Leg-Covers. For example, the free upper portion D3 is still capable of being free of the upper member 12 and movable relative to the housing. Furthermore, the free upper portion D3 is also capable of creating a substantial length of space 15 above the fixable lower portion A3. The substantial length of space is capable of at least accommodating, securing, and utilizing a long, loose fitted pant leg.

As illustrated, in FIG. 1, the PLC XX2 is fixedly joined to the housing. The PLC can be joined through a single piece of material, sewing, adhesive, and/or any other suitable manner including conventional manners known in the art.

Pant-Leg-Covers XX1, XX2 and XX3 (FIG. 1) can be fixedly joined or removably joined to the housing at the fixable lower portions (e.g. depending on consumer and manufacturing preferences). Therefore, the location of the affixed or interchangeable Pant-Leg-Covers will vary. For example, in another embodiment, the PLC XX1 (FIG. 1) can be affixed to the housing, if so desired. Moreover, the PLC XX2 can be removably joined to the housing, if so desired. The interchangeable and affixed aspects of the present invention provide multiple combinations for producing footwear with different characteristics. These aspects are advantageous in marketing multiple lines of footwear that use long, loose-fitted pant legs to at least benefit the consumer.

Figure 2:
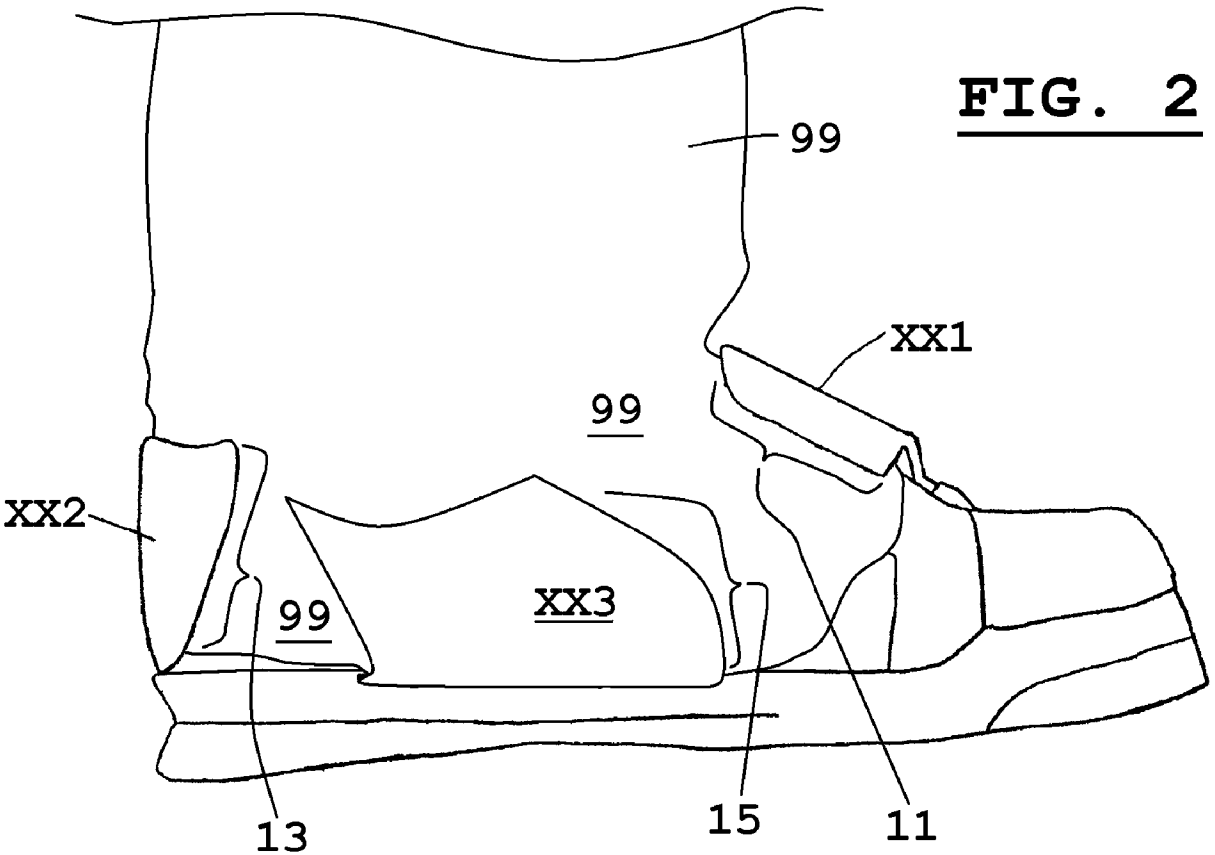
FIG. 2 is a right side view of FIG. 1 that includes a pant leg incorporated into the illustration. This diagram also shows personalized PLC's.

"FIG. 2—Description of Pant-Leg-Covers including Pant Leg" is a view of FIG. 1 with a long, loose fitted pant leg 99 incorporated into the illustration. The PLC's are personalized to the preference of the consumer. FIG. 2 further shows the pant leg 99 accommodated, secured, and utilized in the substantial lengths of space (11, 13, and 15) behind PLC's XX1, XX2, and XX3. Pant leg 99 acts as a contrasting background to the PLC's, enhancing their appearance. The pant leg 99 can be utilized as a contrasting background at any distance down the backside of the PLC's. In at least some embodiments, pant leg 99 is secured and utilized as a contrasting background more than 50% of the way down PLC's XX1, XX2, and XX3. In this particular illustrated embodiment (FIG. 2), pant leg 99 is secured and utilized as a contrasting background nearly 95% of the distance down the Pant-Leg-Covers (based on the total length of each PLC). The size and length of the pant leg will vary from consumer to consumer. Various embodiments are capable of meeting any variation in consumer and/or manufacturer demand.

Figure 3:
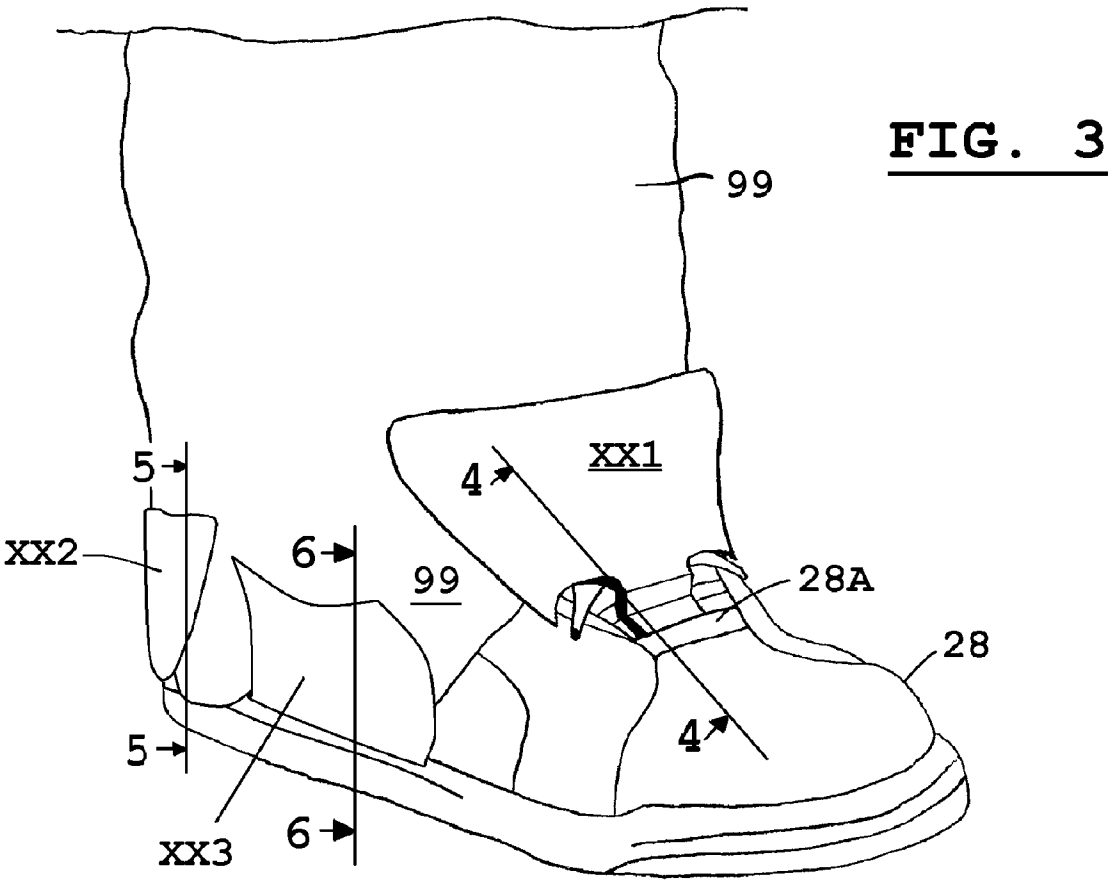
FIG. 3 is a front right view of FIG. 2.

"FIG. 3—Description of Three Pant-Leg-Covers, Front Right View" is the embodiment from FIG. 1 and FIG. 2 viewed at a new angle. This particular embodiment clearly exhibits the pant leg 99 accommodated, secured, and utilized above the housing and below PLC XX1. In other words, pant leg 99 is sandwiched between the housing and an inside surface of PLC XX1. PLC XX1 is joined with the housing at a retainer arm 28A. An engagement feature is built into the front portion of the upper 28 and lies beneath the retainer arm 28A. Also in FIG. 3, pant leg 99 hides a majority of the housing. Pant leg 99 functions as a contrasting background to the PLC's XX1, XX2, and XX3. As mentioned, the contrasting background provided by pant leg 99 increases the marketability of the modified footwear.

Also, FIG. 3 shows how PLC's XX1, XX2, and XX3 are bendable to the contour of the footwear (they wrap around the footwear, maintaining its shape). Again, the PLC's can take on a variety of characteristics to express the consumer's desires. For example, the PLC's can take on a three dimensional shape to represent a team mascot.

Figure 4:
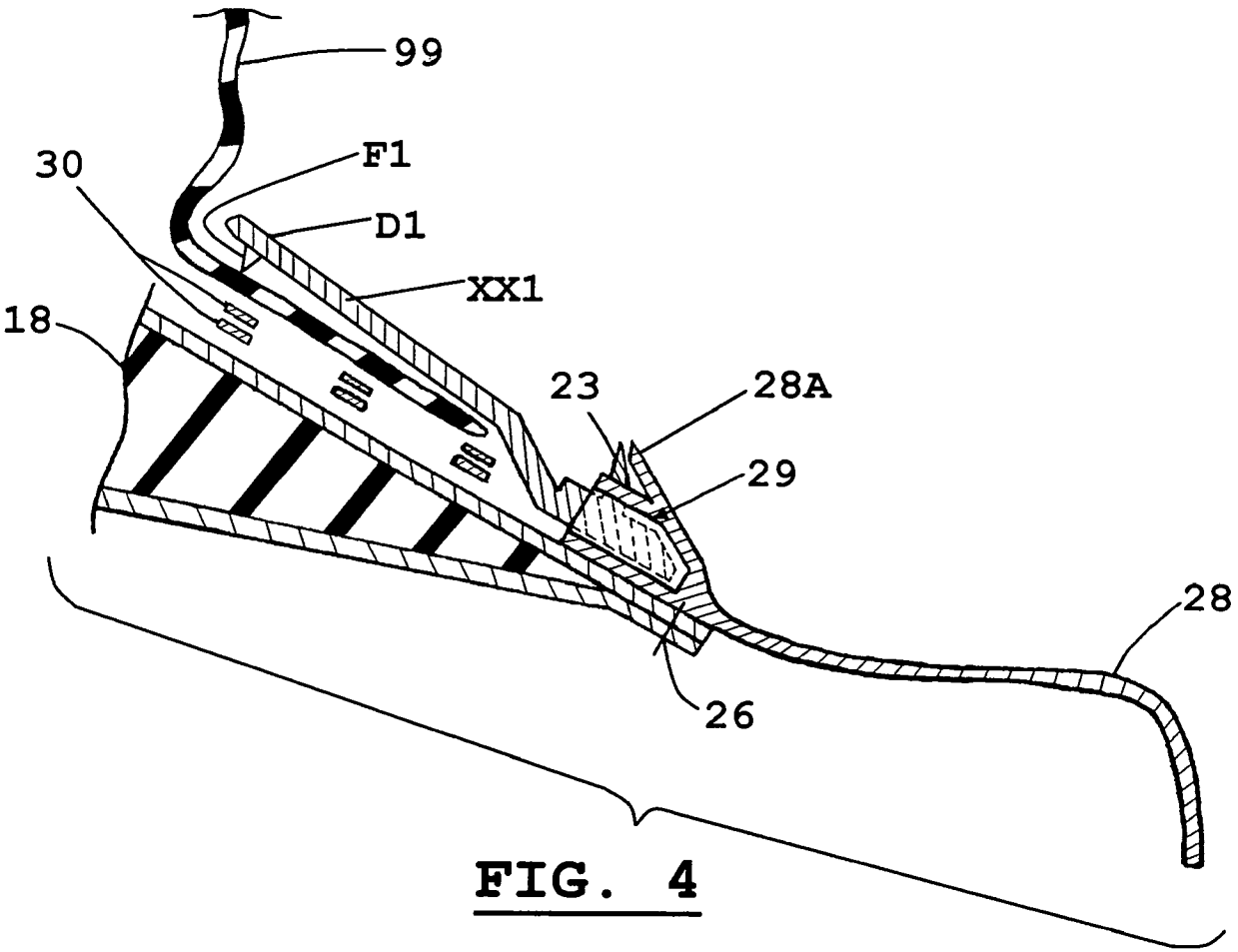
FIG. 4 is a side sectional view taken along line 4-4 of FIG. 3.

"FIG. 4—Description of Engagement of Pant-Leg-Cover XX1" is a side sectional view taken along line 4-4 of FIG. 3. FIG. 4 includes numerous components from previous figures. In this particular embodiment, the foot securing tongue 18 is joined to the front portion of the upper 28 at a point 26. The interchangeable PLC XX1 joins to the embodiment at an engagement feature 29. The engagement feature is built into the front portion of the upper 28 to hide its appearance. Engagement feature 29 is composed of a pocket to accommodate a clip portion 23 (flexible projection). The retainer arm 28A is an extension of the front portion of the upper 28. The retainer arm is located above the engagement feature 29 and extends above the clip portion 23. The retainer arm 28A is designed to hide the appearance of, and hold the position of, the engagement feature 29 and the clip portion 23. This adds stability and enables the embodiment of FIG. 4 to appear as conventional footwear when PLC XX1 is un-joined from the footwear.

Further describing this embodiment (FIG. 4), clip portion 23 is integrally joined with PLC XX1. However, in another embodiment, clip portion 23 can be removably joined with PLC XX1 in any suitable manner (e.g. fastener arrangement). The majority of clip portion 23 is drawn with dashed lines. The dashed lines represent that clip portion 23 is held within the pocket of the engagement feature 29.

FIG. 4 also clearly illustrates how the upper portion D1 of the PLC XX1 is free of the lace-securing members 30 and the foot-securing tongue 18. PLC XX1 is movable relative to the housing. PLC XX1 provides space to at least accommodate, secure, and utilize pant leg 99. In the same manner, this embodiment (FIG. 4) shows pant leg 99 secured and utilized in the space between the housing and PLC XX1. Pant leg 99 can be secured by at least a single fastener arrangement F1, or in any suitable manner. Pant leg 99 hides lace-securing members 30 and foot-securing tongue 18. Pant leg 99 also functions as a contrasting background to PLC XX1.

"FIG. 4—Engagement of Pant-Leg-Cover XX1" illustrates an embodiment that uses two engagement features. The two engagement features (clip portion 23, engagement feature 29) join PLC XX1 with the housing. PLC XX1 includes the engagement feature described, thus far, as clip portion 23. On the other hand, the housing's engagement feature has been described, thus far, as engagement feature 29. I presently contemplate for this embodiment that the clip portion 23 and engagement feature 29 are composed of a strong plastic or metal. However, they can most certainly be made of different materials, or a variety of materials. The different materials, features, and arrangements will have different characteristics. The different characteristics will at least change the weight, durability, cost, efficiency, functionality, etc. of the engagement features. These varying characteristics will provide different and additional advantages to the consumer and/or manufacturer. The engagement features in the embodiment of FIG. 4 are merely a type of fastener arrangement, and any fastener arrangement can be used in their place.

Further describing "FIG. 4—Engagement of Pant-Leg-Cover XX1", the lace-securing members 30 comfortably hold the foot-securing tongue 18 over the top of the consumer's foot. In this specific embodiment, foot-securing tongue 18 does not change. This provides a consistent feel for the consumer's foot. However, other embodiments can include removable foot securing tongues.

Figure 5:
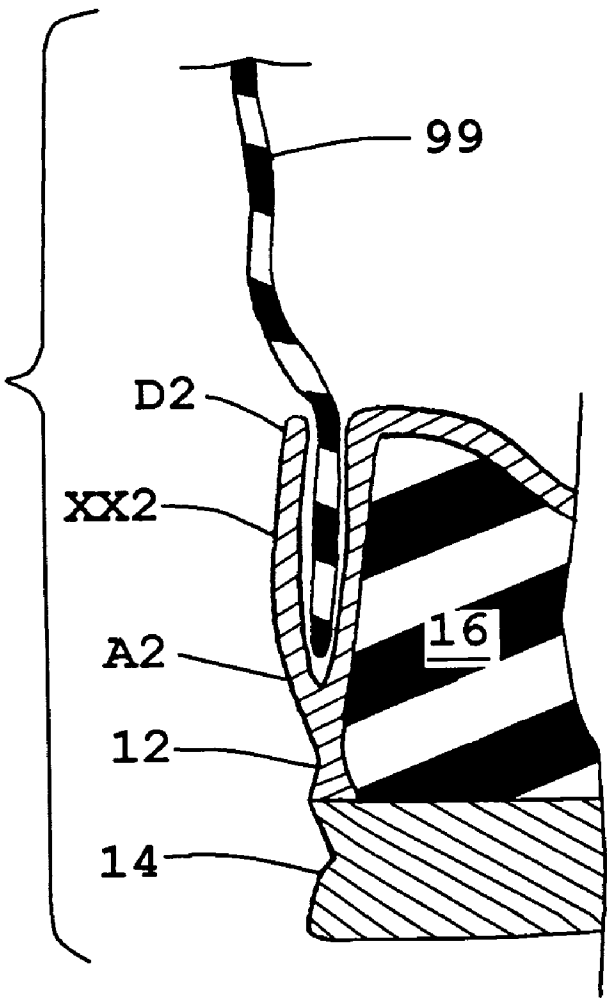
FIG. 5 is a side sectional view taken along line 5-5 of FIG. 3.

FIG. 5 is a side sectional view taken along line 5-5 of FIG. 3. "FIG. 5—Description of Engagement of Pant-Leg-Cover XX2" illustrates an embodiment where the PLC XX2 is joined to the upper member 12. Upper member 12 helps define the interior of the housing 16. The interior of the housing is used to receive a consumer's foot. Interior 16 is located above the sole member 14. The free upper portion D2 of PLC XX2 extends upward from the fixable lower portion A2. The free upper portion D2 is movable relative to the housing. The free upper portion D2 is capable of creating a considerable amount of space between the upper member 12 and the inside surface of PLC XX2. The space can be used to at least accommodate, secure, and utilize the pant leg 99. In this particular embodiment, the inside surface of PLC XX2 is drawn without a fastener arrangement. However, other embodiments can include one or more fastener arrangements on the inside surface of PLC XX2. In the illustrated embodiment, PLC XX2 is built with sufficient rigidity in order to maintain shape and position. The Pant-Leg-Covers can be built with or without fastener arrangements (e.g. depending on consumer and manufacturer preference).

The embodiment of FIG. 5 illustrates PLC XX2. The PLC XX2 can be joined to upper member 12 in any suitable manner known in the art and discussed within this specification (adhesives, sewing, clips, etc.). In this particular embodiment, the upper member 12 and the fixable lower portion A2, of PLC XX2, are unified. Other embodiments of the invention can include a removably joined Pant-Leg-Cover at this proximate location on the housing. PLC XX2 can include other features or characteristics described above and beyond.

Figure 6:
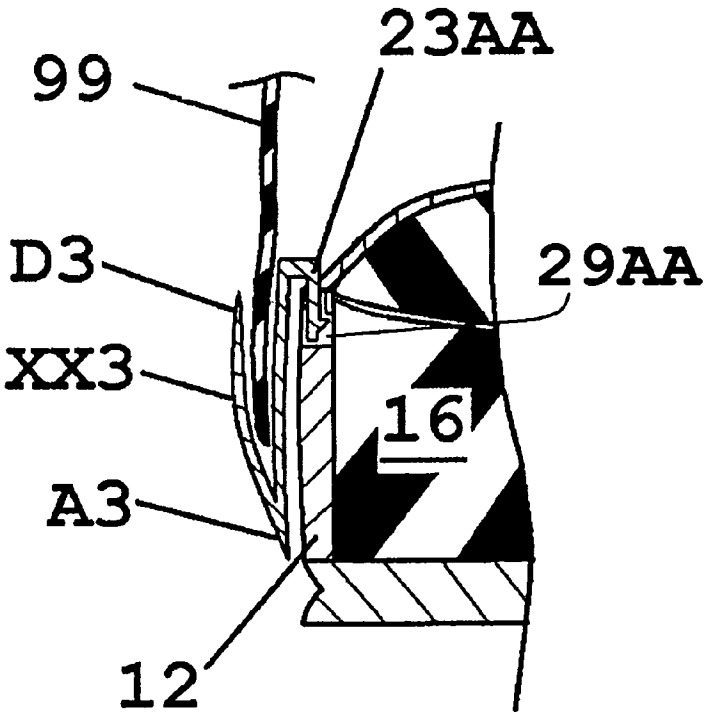
FIG. 6 is a side sectional view taken along line 6-6 of FIG. 3.

"FIG. 6—Description of Engagement of Pant-Leg-Cover XX3" is a side sectional view taken along line 6-6 of FIG. 3. In this particular embodiment, PLC XX3 is joined to the housing by an engagement feature 29AA. The engagement feature 29AA is built into the upper member 12. A clip portion 23AA of the PLC engages with the engagement feature 29AA. The clip portion 23AA and the engagement feature 29AA share characteristics similar to the clip portion 23 and the engagement feature 29AA of "FIG. 4—Engagement of Pant-Leg-Cover XX1."

As illustrated, the embodiment of FIG. 6 includes the fixable lower portion A3 and the free upper portion D3. The free upper portion D3 is capable of being free of the clip portion 23AA and the upper member 12. Furthermore, the free upper portion D3 is capable of creating a significant separation between the clip portion 23AA and the PLC XX3. This results in a substantial length of space above the fixable lower portion A3. As mentioned, the substantial length of space can at least accommodate, secure, and utilize the pant leg 99 (as illustrated).

Clip portion 23AA creates a clean position for an engagement feature on the footwear. The sole member of footwear tends to build up dirt. Clip portion 23AA allows a consumer to have an engagement feature further from the sole of their footwear. Moreover, the engagement feature is less susceptible to dirt or other environmental factors.

Operational Section [FIGS. 1-6]

The embodiments illustrated in FIGS. 1-6 operate in a simple, yet brilliant way. The embodiment of FIG. 1 includes the housing defined by at least the upper member 12, the bottom sole member 14, the lace-securing members 30, the foot securing tongue 18, and the front portion of the upper member 28. The external periphery of the housing includes the additional PLC's XX1, XX2, and XX3. In a conventional way, the closure device (30&18) adjusts to accommodate the consumer's foot within the interior 16. Following is the operation and advantages of the additional Pant-Leg-Covers.

"FIG. 1—Modified Footwear with Three Pant-Leg-Covers" shows the embodiment including the three PLC's. As mentioned, each PLC extends upwardly from the fixable lower portions A1, A2, and A3. The free upper portions D1, D2, and D3 are movable relative to the housing. Therefore, each PLC creates their own substantial length of space (11, 13, and 15) between themselves and the housing. The substantial lengths of space are capable of at least accommodating, securing, and utilizing the pant leg 99 of the consumer. For example, a consumer can easily create the substantial length of space by moving the free upper portion of their PLC away from the housing. Next, the consumer can slide their pant leg between the housing and their PLC. This action at least accommodates, secures, and utilizes their pant leg between the housing and the inside surface of their PLC. "FIG. 2—Pant-Leg-Covers including Pant Leg" illustrates this action completed.

In these embodiments, the location of the PLC's XX1, XX2 and XX3 (FIG. 1, FIG. 2, and FIG. 3) provide great marketing space directed toward people viewing the consumer's footwear from all sides. Another embodiment could include footwear where the PLC's are unified around the external periphery of the housing. Moreover, the PLC's can be joined to, and lie above, any portion of the foot-receiving apparatus. The PLC's also retain the consumer's pant leg from reaching the underside of sole member. This not only reduces the wear and tear put on the pant legs, but also at least keeps the consumer and their pant legs clean, comfortable, fashionable, and safe.

In FIG. 2 and FIG. 3, the pant leg 99 is utilized as a contrasting background to the PLC's. The contrasting background exponentially enhances the appearance of the PLC's. The enhanced appearance of the expressive PLC's greatly increases the marketability of the footwear.

"FIG. 3—Three Pant-Leg-Covers, Front Right View" illustrates PLC's that are personalized to the preference of the consumer. The consumer can order custom PLC's from a manufacturer or personalize them in countless ways. For example, the consumer can use software and the Internet to build a virtual PLC. Next, the consumer can send that virtual image to a manufacturer for production. On the other hand, a consumer can choose to iron-on a patch to customize their PLC. Another consumer can use markers on their PLC, since it can contain a dry-erase type surface. The possibilities of materials and methods for customizing the PLC's are endless, and therefore; as stated, the illustrated examples are not limitations.

"FIG. 4—Engagement of Pant-Leg-Cover XX1" illustrates an embodiment where PLC XX1 is removable and interchangeable. As mentioned, the embodiment of FIG. 4 includes the clip portion 23 and a pocket of the engagement feature 29. The clip portion 23 is integrally joined with PLC XX1. Also, the clip portion 23 fluctuates. Therefore, a consumer can slide the clip portion into the pocket of the engagement feature 29. The clip portion will contract with a little pressure provided from the entrance of the pocket. Thus, clip portion 23 contracts to enter the pocket of engagement feature 29. Once positioned, clip portion 23 then retracts, joining clip portion 23 with engagement feature 29. Clip portion 23 and PLC XX1 (FIG. 4) can be easily and conveniently un-joined from engagement feature 29.

It is easy to un-join clip portion 23 and PLC XX1 from engagement feature 29 (FIG. 4). First, the consumer can apply pressure to the top of clip portion 23. This contracts clip portion 23. At the same time, the consumer can slide the clip portion away from the engagement feature 29. As a result, the clip portion and the PLC are separated from the engagement feature and the housing.

This embodiment easily, quickly, and conveniently un-joins. PLC XX1 from the housing. This embodied method of joining provides the consumer with a safe, quick, easy, convenient, and efficient way to interchange the PLC's with the housing of a foot-receiving apparatus. Yet, any numerous methods, arrangements, and/or materials can be used to benefit the consumer and/or manufacturer.

As mentioned, the embodiment of FIG. 4 includes the retainer arm 28A. The retainer arm helps hide the appearance of clip portion 23 and engagement feature 29. This enables the embodiment of FIG. 4 to appear as conventional footwear when PLC XX1 is un-joined from the housing. However, some consumers will enjoy revealing that they have modified footwear. Therefore, another embodiment can include ornamentation proximate to engagement feature 29. For example, the consumer can choose to use eye-catching engagement features. This can result in a decorative engagement feature, decorative portion of the upper member, or combination thereof.

As mentioned, "FIG. 4—Engagement of Pant-Leg-Cover XX1" also shows how the inside surface of the free upper portion D1 includes a fastener arrangement/s F1. Fastener arrangement/s F1 can connect to at least pant leg 99 to keep it in at least a clean, comfortable, styling, safe, and secure position. When pant leg 99 is not present, fastening arrangement/s F1 can connect to the housing. Connecting PLC XX1 with the housing ensures that the PLC is in at least a safe, comfortable, styling, and secure position for the consumer. The safety of the consumer is important at all times. Fastener arrangement/s F1 (FIG. 4) provides advantages in maintaining style, comfort, and, most importantly, safety. The housing or PLC XX1 can include multiple fastener arrangements similar to fastener arrangement F1.

Furthermore, (as discussed) the consumer can move the free upper portion D1 of FIG. 4 relative to the housing. The movement creates a substantial length of space between the housing and the inside surface of the PLC XX1. This allows the consumer to place their pant leg 99 in the substantial length of space. This space accommodates, secures, and utilizes the pant leg 99 of the consumer. The fastener arrangement/s F1 connect to the pant leg 99 or to the housing (e.g. using alligator clips). Again, fastener arrangement/s F1 (FIG. 4) provide advantages in maintaining style, comfort, and, most importantly, safety.

The fastener arrangement/s F1 keep the pant leg 99 in a set position attributing to the consumer's style. The set position keeps the pant leg comfortably away from the consumer's body, increasing consumer comfort. And most importantly, the fastener arrangement keeps the pant leg close to the footwear. This reduces the possibility of the pant leg becoming hazardous to the consumer. For example, when the pant leg is kept close to the footwear it is far less likely to get caught on any objects (e.g. moving bicycle parts, the top of a metal fence, etc.).

"FIG. 5—Engagement of Pant-Leg-Cover XX2" was pretty well described in the detailed description. The PLC XX2 operates in a very similar way to the PLC XX1. The PLC XX2 extends upwardly from the upper member 12 at the fixable lower portion A2. In this particular embodiment, the PLC is integrally joined with the upper member by adhering, molding, etc. However, PLC XX2 can be joined to the upper member or housing by use of a fastener arrangement (fastening). Again, the free upper portion D2 is movable relative to the housing. Thus, the consumer can place their pant leg between the housing and the inside surface of their PLC. As a result, the pant leg 99 is accommodated, secured, and utilized between the upper member 12 and the inside surface of PLC XX2.

"FIG. 6—Engagement of Pant-Leg-Cover XX3" operates similarly to both PLC XX1, and PLC XX2. Yet, the fixable lower portion A3 does not include the main fastener arrangement or engagement features. Instead, a long clip portion 23AA extends upward from the fixable lower portion A3. The long clip portion 23AA extends up the side of the housing to an engagement feature 29AA. The engagement feature 29AA includes a pocket. The pocket is located at the top of the upper member 12. The engagement feature 29AA and clip portion 23AA share characteristics similar to engagement feature 29 and clip portion 23 of FIG. 4. Yet, the location of engagement feature 29AA's pocket is unique.

In the embodiment of FIG. 6, the exclusive location of the engagement feature 29AA makes operating it and the clip portion 23AA slightly unique. However, joining clip portion 23AA with engagement feature 29AA is the same as the method used in FIG. 4 for clip portion 23 and engagement feature 29. Regardless, un-joining clip portion 23AA from engagement feature 29AA is unique. The pocket of engagement feature 29AA is hidden within the upper member 12. Therefore, in the embodiment of FIG. 6, the consumer must apply pressure to the tip of clip portion 23AA through the side of the upper member 12. At the same time, the consumer must slide the clip portion 23AA upward and away from engagement feature 29AA. This is the slightly unique operation of the interchangeable PLC XX3.

As illustrated, the embodiment of FIG. 6 utilizes the pant leg 99 similarly to other embodiments. Yet, the main engagement feature is not directly at the fixable lower portion A3. The embodiment of FIG. 6 provides the consumer with an engagement feature further from the ground. This embodiment keeps the clip portion and engagement features further from dirt, water, and other environmental factors.

The fixable lower portion A3 of FIG. 6 can contain a fastener arrangement. The fastener arrangement can connect the fixable lower portion to the housing. This keeps the PLC XX3 in a close, safe position to the housing.

Advantages [FIGS. 1-6]

From the description above, a number of advantages of some embodiments of my modified footwear including Pant-Leg-Covers become evident:

(A) The modified footwear's appearance is very similar to conventional footwear. Therefore, the modified footwear will appeal to current consumer and market tastes.

(B) The consumers can easily, conveniently, efficiently, and comfortably secure a long, loose-fitted pant leg between the housing and the PLC's, if so desired.

(C) The consumer can choose to own footwear including multiple PLC's. The multiple locations of the PLC's provide additional marketing space for the consumer. This increases the degree to which the consumer can express themselves.

(D) The multiple locations of PLC's provide the manufacturer with numerous ways to increase product differentiation.

(E) The PLC's can be fixedly joined or removably joined to the housing, if so desired (e.g. depending on consumer and manufacturer preferences).

(F) The multiple aspects of joining the PLC's with the housing also increase the manufacturer's ability to differentiate product lines.

(G) The consumer can easily, conveniently, efficiently, and securely join the PLC's with the modified footwear, if so desired.

(H) With the PLC's joined to the housing; the PLC's create the substantial lengths of space that are capable of accommodating, securing, and utilizing the pant legs of consumers. As a result, the PLC's increase at least the consumer's safety, convenience, cleanliness, comfort, fashion, and personal expression.

(I) The consumer's pant legs can secured off the ground and at least kept clean, styling, and in one piece.

(J) The consumer's pant legs are secured close to the housing of the footwear. As a result, the pant legs are not likely to get caught on objects such as moving bicycle parts. This increases consumer safety.

(K) The pant leg of the consumer acts as a contrasting background to the expressive PLC. This exponentially increases the visibility of the consumer's PLC. As a result, this increases the marketability of the modified footwear.

(L) The consumer can easily, conveniently, and efficiently un join the PLC's with the modified footwear, if so desired.

(M) With the PLC's un joined from the housing, the modified footwear appears to be conventional footwear, if so desired.

(N) With the PLC's un-joined from the housing; the modified footwear can include additional ornamentation making it apparent that the footwear is modified, if so desired (a different consumer taste).

(O) The consumer can customize their PLC's. To customize, the consumer can use at-home methods or they can send their PLC's to a hired designer, if so desired.

(P) The consumer can personalize or customize their PLC's in countless ways, if so desired.

(Q) The consumers can use countless custom materials, figures, shapes, objects, etc. to express themselves, if so desired.

(R) The consumer is able to express themselves, to an extreme degree. Their personalized footwear will not be covered by wearing long, loose-fitted pant legs, if so desired.

(S) The consumer is able to express themselves above the closure device on their footwear, if so desired.

(T) The consumer can interchange PLC's on their single pair of modified footwear, if so desired. This potentially saves the consumer money from purchasing multiple pairs of footwear to express themselves.

(U) The modified footwear provides a select corporation with a unique and sustainable competitive advantage over their fierce competition.

(V) The manufacturers are provided with a modified piece of footwear that is marketable to one of the highest grossing target markets.

(W) The modified footwear provides an entirely new field of advertising. Corporations can now reach their own consumers wherever they travel. Consumers can now express these advertisements at least through the shoes on their feet. Pant legs will not cover the advertisements. The advertisements are interchangeable and customizable, therefore; the consumer is able to constantly change their advertisements. This is the newest way to reach; at least, the youth target market.

(X) The PLC advertisements are not only a billboard advertisement; they also provide a satisfied customer behind the advertisement. Therefore, a corporation's advertisement can be seen and positively reinforced (verbally) by the consumer wearing the foot-receiving apparatus.

(Y) The manufacturer is provided with multiple locations of positioning PLC's, multiple fastener arrangements, multiple characteristics of PLC's, etc. This opens opportunities for differentiating product lines. Expanded product lines appeal to more potential consumers. More consumers will increase sales and revenues. Proper strategy combined with increased revenues equates to a higher profit margin, which expands shareholder value. Expanding shareholder value is critical in this competitive industry.

Additional Advantages Follow . . .

Figure 7:
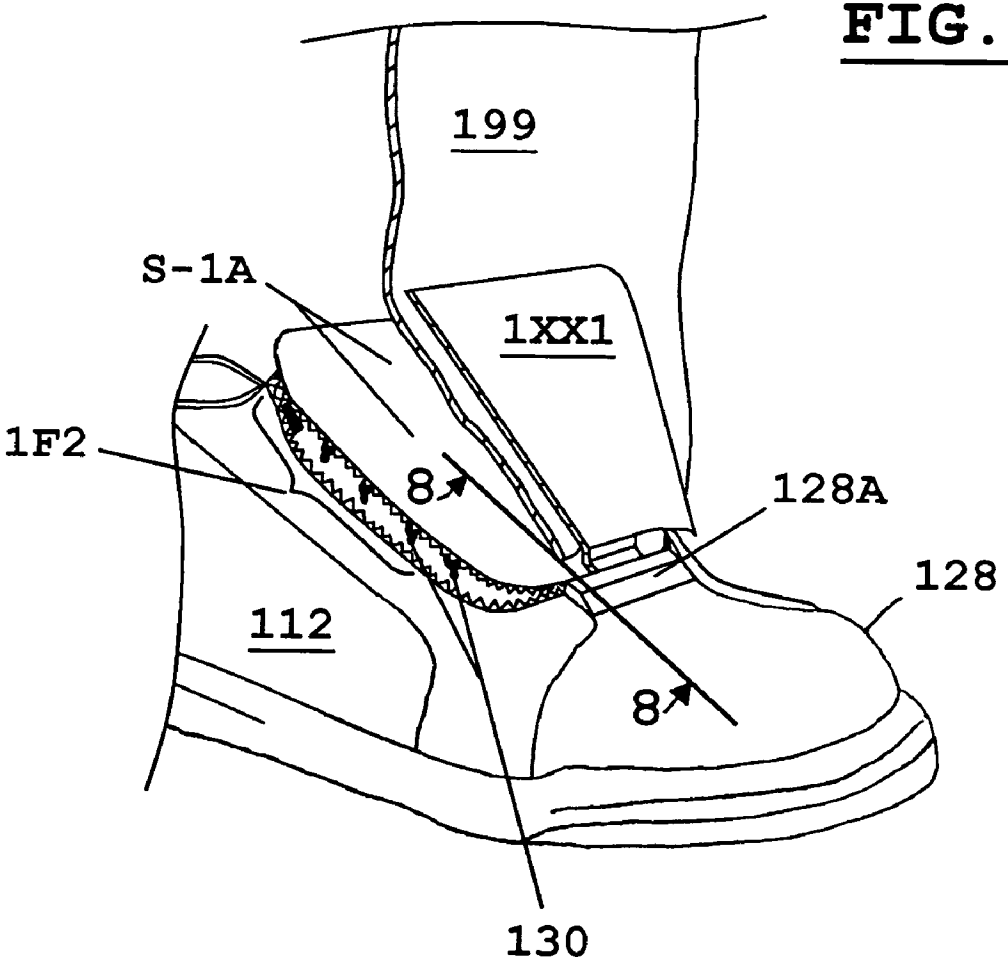
FIG. 7 is a front right view of a foot-receiving apparatus including combined expressive features.

"FIG. 7—Description of Combined Expressive Features" illustrates an alternative embodiment at a front right view. For convenience, I have utilized the same reference numerals of FIGS. 1-3 in FIG. 7, except they are now preceded by a "1". The embodiment of FIG. 7 includes a Pant-Leg-Cover 1XX1 joined to the housing at a retainer arm 128A. The retainer arm is an extension of a front portion of the upper member 128. An upper member 112 includes a length of a fastener arrangement 1F2. Connecting to the other end of the fastener arrangement is a surface portion S-1A. The surface portion is the top part of a foot securing tongue. A series of lace-securing members 130 lie between both portions of the fastener arrangement 1F2. Furthermore, a pant leg 199 is sandwiched between the surface portion S-1A and the PLC 1XX1. The PLC 1XX1 and the pant leg 199 are sectioned in order to see the surface portion S-1A.

Figure 8:
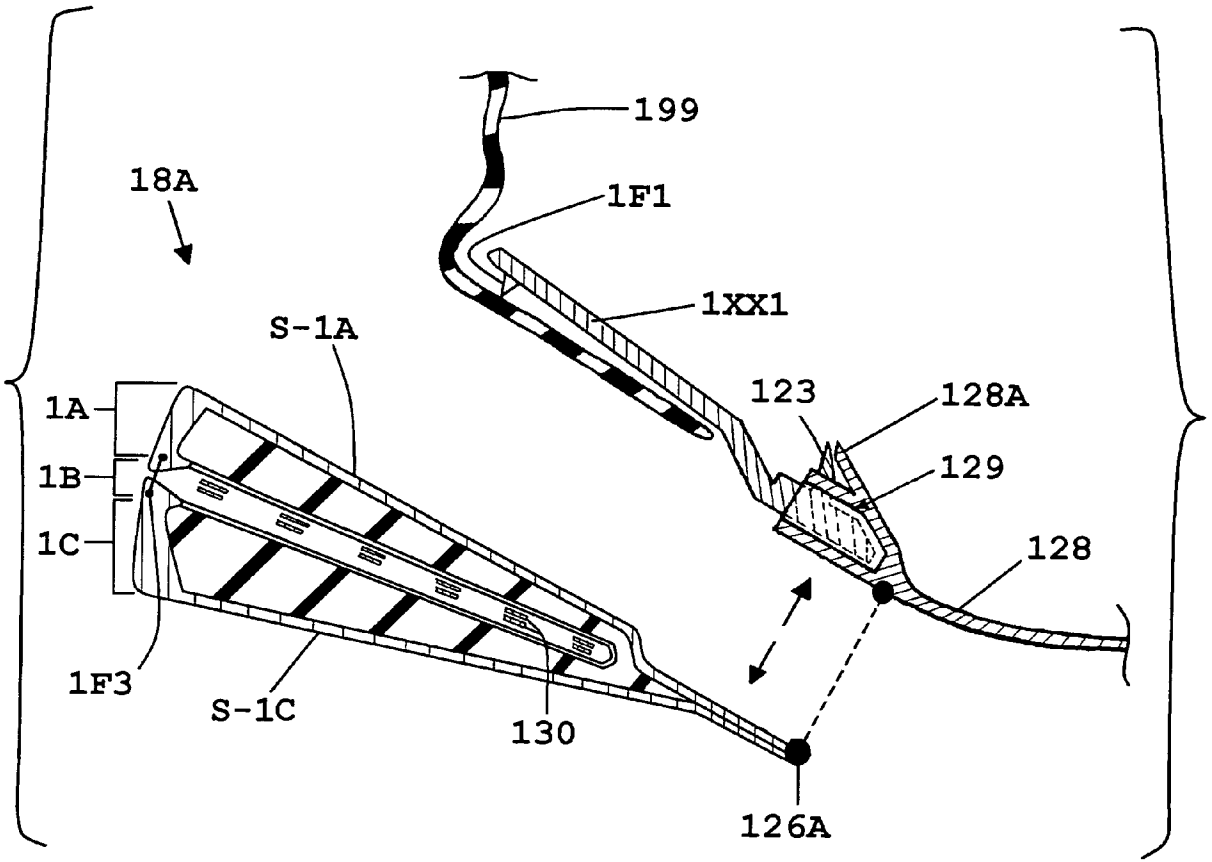
FIG. 8 is a side sectional view taken along line 8-8 of FIG. 7.

"FIG. 8—Description of Combined Expressive Features, Side Section" illustrates a side sectional view taken along line 8-8 of FIG. 7. The embodiment of FIG. 8 includes a removable, interchangeable foot securing tongue 18A. The foot securing tongue is removably joined to the front portion of the upper member 128 at a fastener arrangement 126A. Foot securing tongue 18A can be removably joined to the front portion of the upper 128 by a fastener arrangement or in any other suitable manner. Moreover, the embodiment also includes interchangeable PLC 1XX1 that lies above pant leg 199. The foot securing tongue 18A includes additional features to a conventional foot securing tongue (beyond being removable).

Similarly to previous embodiments, the embodiment of FIG. 8 includes a pant leg 199, a fastener arrangement 1F1, a clip portion 123, a retainer arm 128A, an engagement feature 129, and a front portion of the upper member 128. The fastener arrangement 1F1 can be connected to the PLC 1XX1 in any suitable manner (e.g. adhesives, sewing, etc.). The clip portion 123, retainer arm 128A, and engagement feature 129 carry the same characteristics as the clip portion 23, the retainer arm 28, and the engagement feature 29 from FIG. 4 of the appended drawings.

"FIG. 8—Combined Expressive Features, Side Section" is only one embodiment. Thus, some embodiments will vary from the illustration. For example, the at least one foot securing tongue 18A can be joined with the at least one Pant-Leg-Cover 1XX1. Moreover, at least one fastener arrangement can join both PLC 1XX1 and foot securing tongue 18A to the housing. PLC 1XX1 can join with foot securing tongue 18A in any suitable manner.

Foot securing tongue 18A, in this particular embodiment (FIG. 8), is not a conventional foot securing tongue. However, a conventional, foot securing tongue could be used in place of foot securing tongue 18A. I presently contemplate for this embodiment that the foot securing tongue be composed of soft, comfortable foam. Cloth or any other suitable materials known in the art can encase the soft, comfortable foam. However, foot securing tongue 18A could be made of a variety of materials, or combination of materials. The differing materials will add different characteristics to the embodiment of FIG. 8. The different characteristics will bring various advantages to benefit the consumer and/or manufacturer.

Foot securing tongue 18A (FIG. 8) is broken into three portions for clear description: portion 1A (Top), portion 1B (Middle), and portion 1C (Bottom). Portion 1A of FIG. 8 is the top portion of foot securing tongue 18A. Portion 1B is the middle portion of foot securing tongue 18A. Portion 1C is the bottom portion of foot securing tongue 18A. Each portion serves a unique purpose. Each portion can include unique characteristics to benefit the consumer. The portions will be described as follows: portion 1A, portion 1B, and then portion 1C (ABC).

Portion 1A is the top portion of foot securing tongue 18A (FIG. 8). As illustrated in this embodiment, portion 1A lies below both pant leg 199 and PLC 1XX1. Portion 1A also has a surface portion S-1A. Surface portion S-1A is visible in real-life scenarios. Such as, when a consumer wears short pants and detaches their PLC 1XX1. Surface portion S-1A lies above lace-securing members 130. In other words, lace-securing members 130 do not cover surface portion S-1A. This exponentially increases the visibility of surface portion S-1A. As a result, the marketability potential of the embodiment increases. Moreover, similarly to PLC's, the consumer can customize surface portion S-1A in any suitable or mentioned manner. Surface portion S-1A can have characteristics and features relating to PLC's, described above and beyond.

Portion 1B, of FIG. 8 is sandwiched between portion 1A and portion 1C. Portion 1B is a hollow space between portion 1A and portion 1C. Portion 1B spans the width of foot securing tongue 18A. Lace-securing members 130 can be threaded through portion 1B. Portion 1B is used to accommodate and diminish the appearance of lace-securing members 130. Portion 1B can include a fastener arrangement 1F3 to connect portion 1A (top) and portion 1C (bottom).

The fastener arrangement 1F3 (FIG. 8) allows for a separation between portion 1A and portion 1C. Lace-securing members 130 can be slid through the separation at fastener arrangement 1F3. Therefore, the consumer will not have to thread each lace-securing member 130 through portion 1B. This is efficient when interchanging or reversing foot securing tongue 18A. However, it is possible for portion 1A and portion 1C to be affixed to one another at fastener arrangement 1F3. Portion 1A can be affixed to portion 1C in any suitable manner know in the art (e.g. sewing, adhesives, etc.) Fastener arrangement 1F3 can be located at any portion on the foot securing tongue 18A. For example, fastener arrangement 1F3 can be located at a lower portion of foot securing tongue 18A (close to fastener arrangement 126A).

I presently contemplate for this embodiment the dimensions and the materials used to line portion 1B. For example, portion 1B can be broken into individual lacing sections. Moreover, lace-securing members 130 can connect with portion 1A (top) or portion 1C (bottom) in any suitable manner known in the art. I believe the dimensions and advantages of those dimensions will vary between product lines. Currently, I believe a cloth or plastic-like material will be well suited to line portion 1B. However, any suitable material will be capable of lining portion 1B. Various materials will provide various advantages to benefit the consumer. Any suitable material and any suitable amount of material can be used within the different portions of this embodiment In the embodiment of FIG. 8, portion 1C lies directly above the consumer's foot. Portion 1C includes a surface portion S-1C. In this embodiment, foot securing tongue 18A can include decorative ornamentation on both surface portion S-1A and surface portion S-1C. Moreover, foot securing tongue 18A can be reversible. This allows the consumer to have multiple decorative ornamentations on a single, reversible foot securing tongue 18A. In this particular embodiment (FIG. 8), portion 1C is positioned to comfort the top of the consumer's foot. However, as mentioned, other embodiments are possible.

"FIG. 8—Combined Expressive Features" includes Pant-Leg-Cover 1XX1 and foot securing tongue 18A. While wearing pant leg 199, consumers can express themselves using PLC 1XX1. While wearing short pants, consumers can express themselves using foot securing tongue 18A. The presence of pant legs and closure devices no longer limit consumer expression. Using the combined expressive features of FIG. 8, consumers can express themselves, the best they can, in any real-life scenario. The pluralities of removable features combine to create an extremely unique piece of modified footwear. These mentioned embodiments provide the consumer with multiple options and provide the manufacturer with a substantial base for product differentiation.

Operational Section [FIGS. 7&8]

"Operation of Combined Expressive Features" The manner of using Pant-Leg-Cover 1XX1 in the embodiment of FIG. 8 is identical to the manner of using PLC XX1 in FIG. 4. As noted, many of the portions of the embodiment are identical, yet their reference numerals are now preceded by a "1".

The advantage to this embodiment is that with, or without, the long pant leg 199 the consumers can express themselves to a greater degree than conventional footwear. The reason is that the embodiment includes the PLC 1XX1 and the modified foot securing tongue 18A. However, as described, the interchangeable foot securing tongue is modified to accommodate the lace-securing members 130. Moreover, the embodiment of FIG. 8 provides at least two different customizable, and interchangeable portions on the footwear. However, in other embodiments the customizable portions of the footwear might be joined to the housing in a permanent manner (e.g. sewing, adhesives, etc.).

The modified foot securing tongue 18A connects to the front portion of the upper member 128 at the point 126A. Point 126A can use any type of or combination of fastener arrangements noted in the "Terms" section of this specification. As a result, the consumer can freely choose to connect or disconnect the modified foot securing tongue from the front portion of the upper member. They can by simply operating the fastener arrangement. For example, when the point 126A uses a hook and loop type fastener arrangement, the consumer can easily, quickly, and conveniently pull apart the hook and loop fastener. This would disconnect the modified footwear tongue. Conversely, the consumer can connect the hook and loop fastener by placing the corresponding fastening pieces together and applying slight pressure with their hands. This method is only one example of a fastener arrangement that can be used in accordance with the embodiment of FIG. 8.

As illustrated in the embodiment of FIG. 8, the modified foot securing tongue can be opened easily at fastener arrangement 1F3 to accommodate the lace-securing members 130. Again, the fastener arrangement 1F3 can be any type of or combination of fastener arrangements noted in the "Terms" section of this specification. For convenience, we will describe a hook and loop type fastener for fastener arrangement 1F3. This fastener arrangement will be operated as described above. Therefore, by pulling apart the portion 1A and the portion 1C of the modified foot securing tongue, the consumer can slide the lace-securing members into the portion 1B. Next, the consumer can use their hands to squeeze together portion 1A and portion 1C, securing the corresponding pieces of the fastener arrangement 1F3. As a result, the lace securing members do not jeopardize the expressive tongue on the footwear.

The embodiment of FIG. 8 gives the consumer at least three customizable portions on the footwear. The PLC is customizable as described throughout this specification. Uniquely, the modified foot securing tongue 18A is able to have at least two customizable portions. Surface portion S-1A and the surface portion S-1C are both customizable. They can be customizable in any manner that is related to customizing PLC's. Therefore, the modified foot securing tongue can be reversed or rotated. As a result, (from the embodiment of FIG. 8), if rotated, the surface portion S-1C would then be located on top. This provides the consumer with a modified foot securing tongue that is able to display decorative ornamentation on at least two sides.

The modified footwear described above can easily include other modifications to improve consumer comfort both on the inside and outside of the housing. Also noteworthy; the housing of any of the various embodiments can be altered to accommodate the features and characteristics of Pant-Leg-Covers to benefit the consumer and/or manufacturer.

Advantages [FIGS. 7&8]

From the descriptions above, a number of advantages of some embodiments of my footwear including combined expressive features become evident:

(A) The footwear including combined expressive features carries all advantages from previous FIGS. 1-6, (labeled A-Y, above).

(B) When not wearing long, loose-fitted pant legs, the consumer can detach their PLC and still have an expressive portion of footwear above their closure device (the decorative surface portion).

(C) As mentioned, the modified foot securing tongue is capable of at least accommodating a closure device. As a result, the closure device remains below the customizable surface portion.

(D) The modified foot securing tongue includes a decorative surface portion. The decorative surface portion is customizable and interchangeable. This benefits the consumer in at least two ways. First, the consumer does not need multiple pairs of shoes to express themselves differently. As a result, this saves the consumer money. Second, the consumer has the decorative surface portion that they can customize to express their own personal desires (above their closure device!).

(E) The consumer can customize their modified foot securing tongue's surface portions in any way discussed for customizing PLC's.

(F) The modified foot securing tongue is capable of including decorative ornamentation on multiple sides. This increases the options for the consumer to express themselves.

(G) The modified foot securing tongue can be made of various materials to benefit the consumer/and or manufacturer.

(H) The modified foot securing tongue can be attached to the housing a plurality of fastener arrangements. These fastener arrangements can be hidden or visible to the surrounding environment.

(I) The modified foot securing tongue can include fastener arrangements on the surface portion. The fastener arrangements on the surface portions can join to the housing. This keeps the contour of the footwear and avoids flailing portions on the footwear. As a result, this not only increases consumer fashion, but also increases consumer safety. Additional benefits are possible.

(J) The modified foot securing tongue can include fastener arrangements at any portion below the surface portion too. These fastener arrangements can make it easy for the consumer to accommodate their closure device. Again, the closure device is accommodated below the decorative surface portion. Thus, the consumer can easily, conveniently, and efficiently interchange their modified foot securing tongue. This saves the consumer time, frustration, and energy.

(K) The portion 1B of FIG. 8 can allow the consumer to strategically place their closure device beneath their decorative surface portion. This allows the consumer to place their closure device at a personal place on their foot, increasing consumer comfort.

Figure 9:
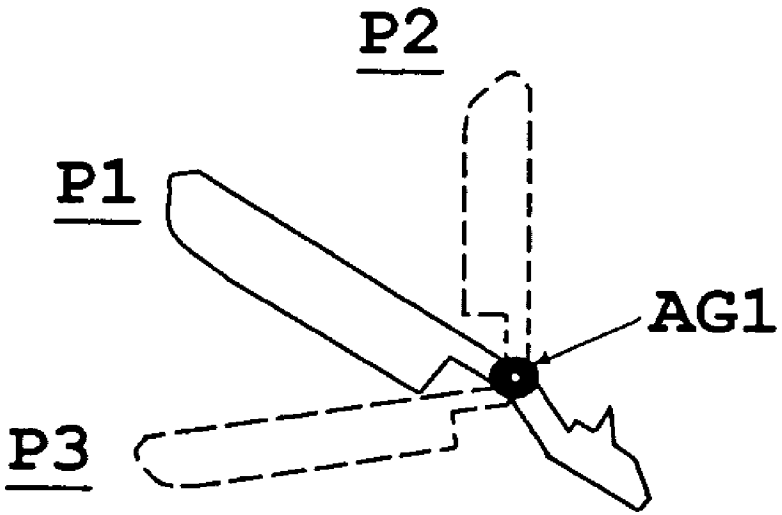
FIG. 9 is a side view of a PLC including an adjustment mechanism.

"FIG. 9—Description and Operation of Pant-Leg-Cover including Adjustment Mechanism" is a side view of an embodied PLC. The PLC includes an adjustment mechanism AG1. The PLC is drawn in three positions: P1, P2, and P3. The multiple positions provide different angles to which the PLC can be viewed. The positions illustrated P1, P2, and P3 are only examples and not set positions. Adjustment mechanism AG1 provides the PLC with a wide range of adjustable motion for the consumer. Adjustment mechanism AG1 allows for the PLC to be locked into countless positions. Adjustment mechanism AG1 is similar to a hinge mechanism that can be found on cellular phones today. For example, a cellular phone can have a hinge mechanism that allows it to open, exposing the phone's keypad and screen. Yet, adjustment mechanism AG1 has the ability to lock into many different positions to secure a specific angle desired by the consumer.

The embodiment of FIG. 9 can be adjusted by rotating the PLC about the adjustment mechanism AG1. I presently contemplate that the embodiment of FIG. 9 uses different levels of pressure to lock the adjustment mechanism into different positions. However, a locking mechanism or any other type of device can be used in this embodiment to regulate the movement of the PLC. Thus, a consumer can use pressure provided by their hands to rotate the PLC around the adjustment mechanism AG1.

Figure 10:
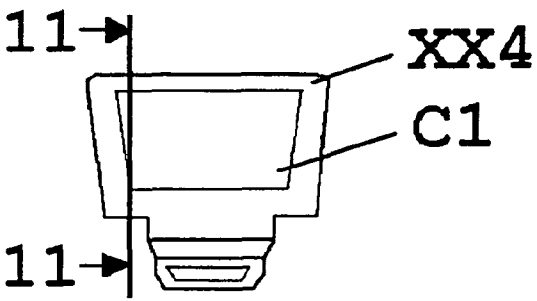
FIG. 10 is a front view of a PLC including a compartment casing.

"FIG. 10—Description of PLC with Electronic Device Carrier" is a front view of a Pant-Leg-Cover XX4. The PLC XX4 includes a built-in compartment casing C1. This particular embodiment uses the compartment casing C1 to hold an electronic display device. However, compartment casing C1 is capable of holding photographs, drawings, objects, etc. or anything the consumer desires to express. In this particular embodiment, compartment casing C1 is a clear display case. Compartment casing C1 can be joined or removably joined to the PLC XX4 in any suitable manner, such as, but not limited to adhesives, sewing, fastener arrangements, etc. Compartment casing C1 can take on a variety of shapes, sizes, and characteristics to resemble at least the contour and characteristics of the PLC's, electronic devices, or footwear. For example, one compartment casing can have a flat panel, while another compartment casing is rounded.

The embodiment of FIG. 10 uses at least one compartment casing to carry an electronic display with at least the Pant-Leg-Cover. However, an electronic display can be carried on the PLC in any suitable manner. Any method can be used to benefit at least the consumer and/or manufacturer.

Compartment casing C1 (FIG. 10) allows for multiple companies (not necessarily footwear companies) to compete for market share in the footwear industry. This is possible because compartment casing C1 enables the consumer to interchange different electronic display devices. For example, one consumer can be able to afford an expensive electronic display while a separate consumer cannot. Multiple electronic companies can provide electronic display devices at different prices. Therefore, the embodiment of FIG. 10 provides options for consumers on different budgets. This embodiment will also influence companies to compete in creating the most innovative electronic display for the embodiment.

Other advantages are apparent from the embodiment of FIG. 10. Pant-Leg-Cover XX4 provides a border to compartment casing C1 (e.g. blue wave theme). As consumers change electronic images in compartment casing C1 they can change their corresponding border. For example, when a consumer has a video of surfing a huge wave being displayed, the consumer can have a beach or blue wave border/theme. This embodiment allows the consumer to interchange their electronic component, photo, etc. Thus, the electronic component can be interchanged into new Pant-Leg-Covers that have corresponding borders/themes. This embodiment will save the consumer money, since the electronic components (most expensive parts) are interchangeable. Numerous suitable methods for displaying consumer desires can be used on the Pant-Leg-Covers to at least increase the marketability of the foot-receiving apparatuses.

Figure 11:
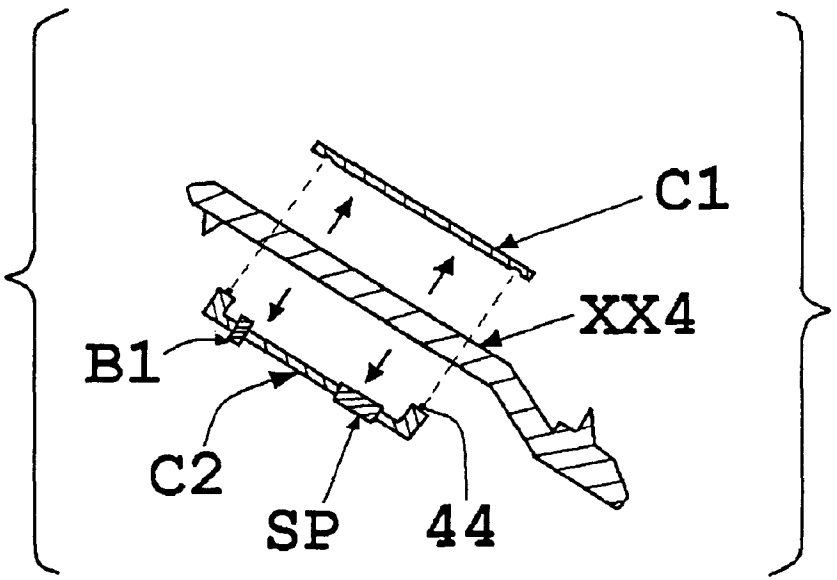
FIG. 11 is a side sectional view taken along line 11-11 of FIG. 10.

"FIG. 11—PLC with Electronic Device Carrier, Side Section" is a side sectional view taken along line 11-11 of FIG. 10. PLC XX4 includes the compartment casing C1 and a compartment casing C2. An electronic display can be sandwiched between compartment casing C1 and C2. The compartment casings C1 and C2 are exploded away from one another. In this embodiment, compartment casing C1 is fixedly joined to the PLC XX4 in any suitable manner. On the other hand, compartment casing C2 is removable from Pant-Leg-Cover XX4 and compartment casing C1. Removable compartment casing C2 makes it possible to interchange electronic display devices or other items between the compartment casings. A seal member 44 (FIG. 11) is located between the compartment casings. The seal member ensures that the electronic display device does not get damaged from the surrounding environment (e.g. dirt, water, other liquids, etc.).

This particular embodiment of FIG. 11 shows how compartment casing C2 includes a built-in button B1. The built-in button B1 makes it possible for the consumer to at least turn their electronic display device on, or off, without removing it from between compartment casings C1 and C2. The compartment casing C2 also includes a speaker port SP. The speaker port is used to transfer sound out of the compartment casing. Multiple built-in buttons can be used similar to built-in button B1. These buttons are able to operate multiple functions for the electronic display, including but not limited to: power, volume, mute, contrast, brightness, etc.

Figure 12:
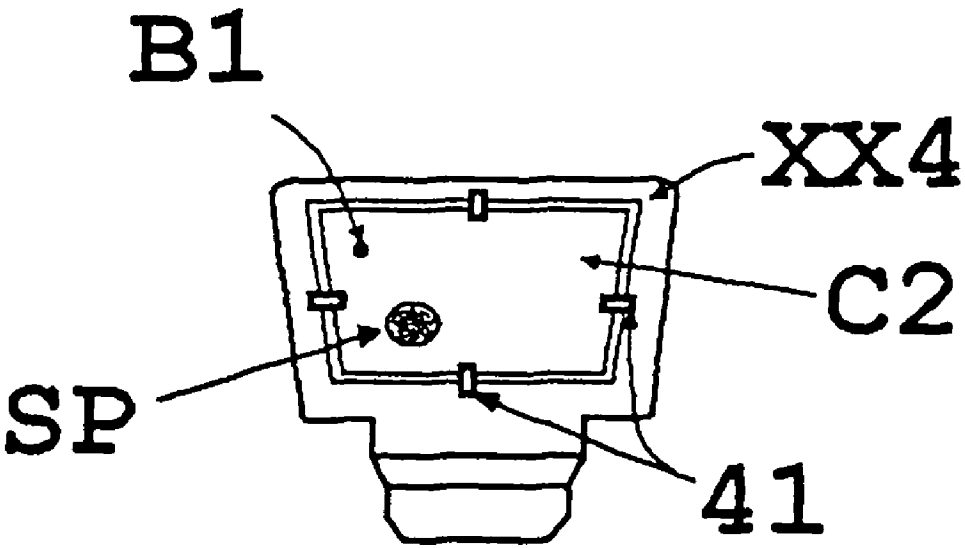
FIG. 12 is a back view of FIG. 10.

"FIG. 12—PLC with Electronic Device Carrier, Back View" is the back view of FIG. 10. This embodiment shows how compartment casing C2 is held to at least PLC XX4. Compartment casing C2 is held to at least PLC XX4 by multiple fastener arrangements 41. I presently contemplate for this embodiment that the fastener arrangements can be composed of screw-like fasteners. However, various fastener arrangements are suitable, such as, those listed under "fastener arrangements" in the "Terms" section of this specification, or any other suitable manner. The fastener arrangements can be composed of a variety of instruments and minimal pieces (e.g. single fastener arrangements). Moreover, the direction and convenience for which the electronic display device will enter between the casings will vary from product line to product line.

Figure 13:
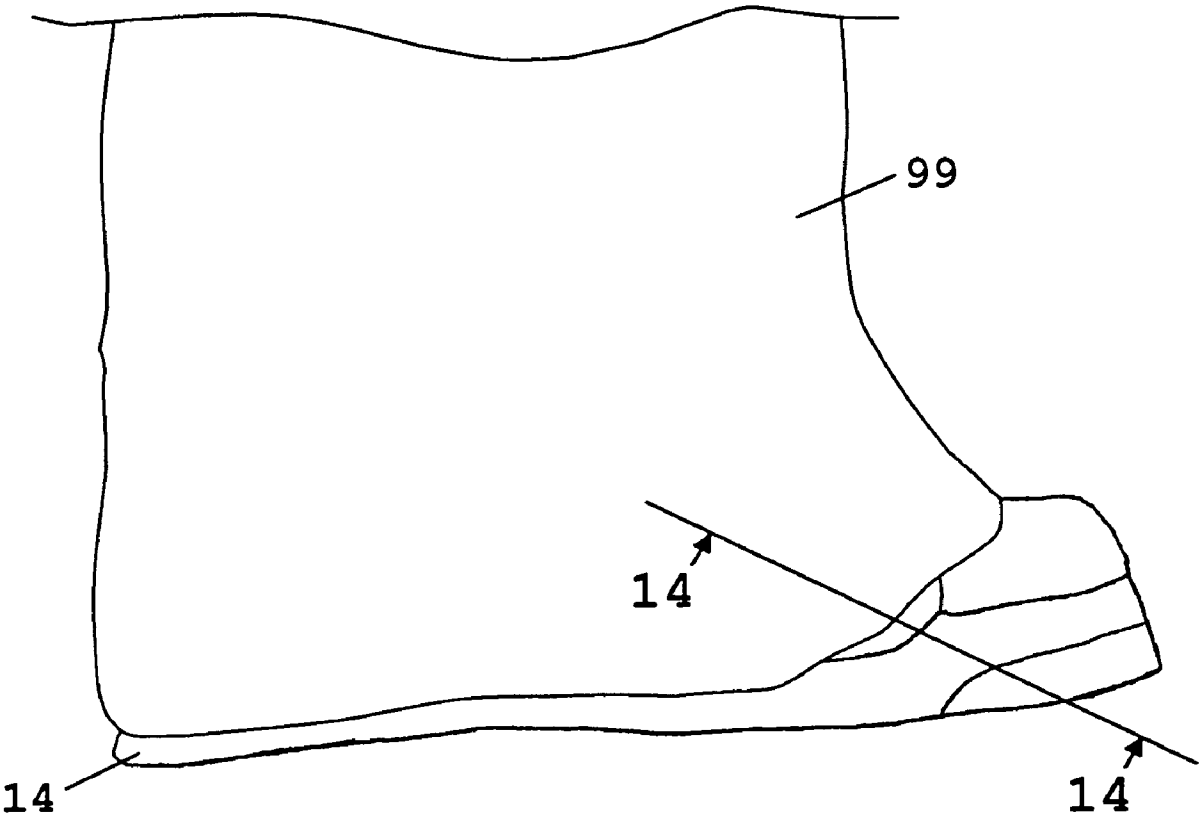
FIG. 13 is a right side view of a modified piece of footwear that is covered by a pant leg.

"FIG. 13—Additional Battery and Memory without PLC Engaged" is an illustration where the pant leg 99 covers a majority of the housing. From this embodiment, it is evident that a visual display on the housing of the footwear would not be clearly visible to the consumer and people in the surrounding environment. Again, the pant leg 99 covers the majority of the housing. In turn, the pant leg potentially jeopardizes the expressive, visual portions on the footwear.

The embodiment of FIG. 13 appears to be conventional footwear. However, the embodiment of FIG. 13 is modified footwear. A sole member 14 includes an additional battery and memory source. The additional battery and memory source will be described in the following embodiment which is a side sectional view taken along line 14-14.

Figure 14:
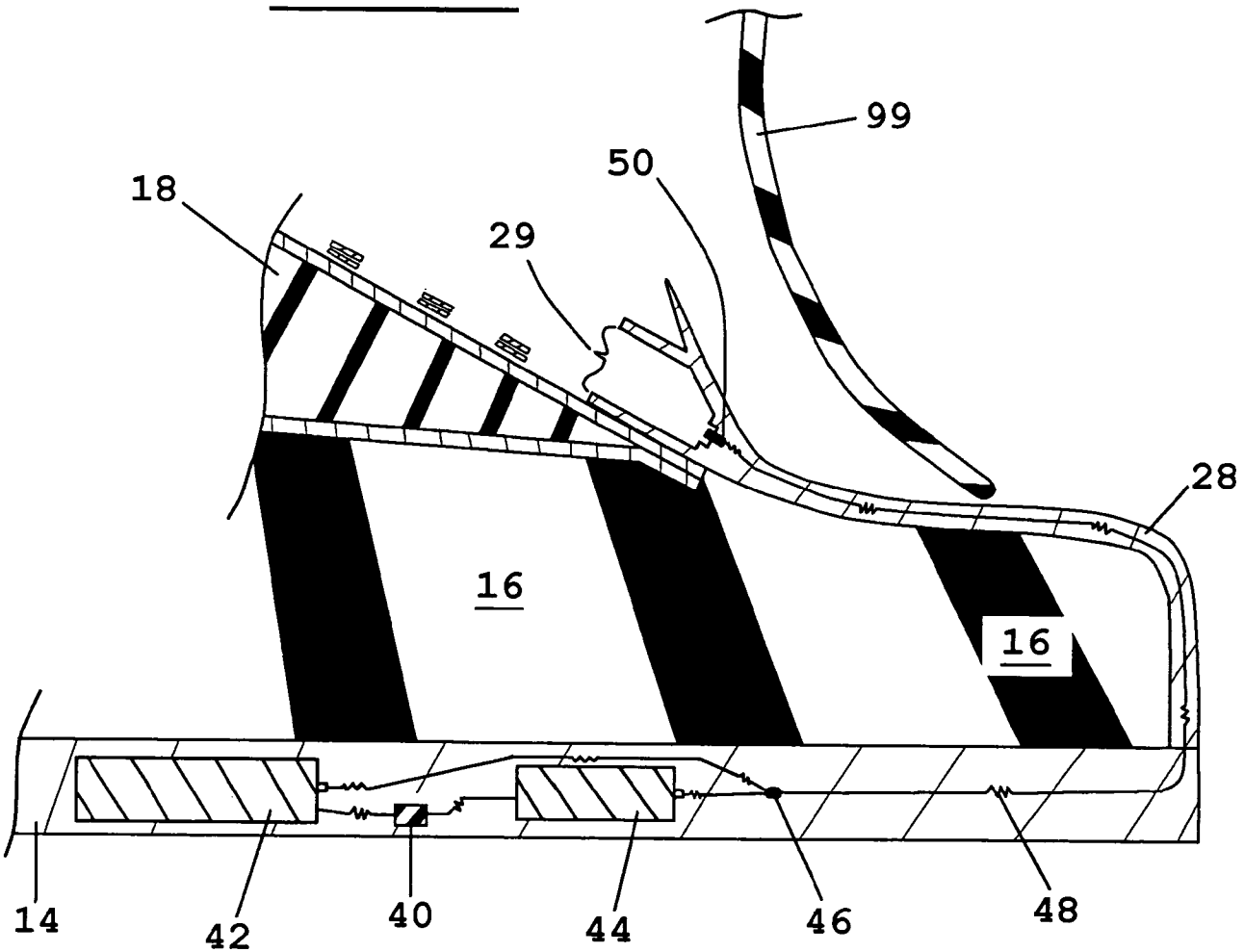
FIG. 14 is a side sectional view taken along line 14-14 of FIG. 13.

"FIG. 14—Description and operation of Additional Battery and Additional Memory Setup" is a side sectional view taken along line 14-14 of FIG. 13. The embodiment of FIG. 14 includes the pant leg 99, the front portion of the upper member 28, and the sole member 14. The front portion of the upper member and the sole member can be connected in any suitable manner known in the art, including manners mentioned for prior figures, but not limited to sewing, adhesives, etc. The embodiment of FIG. 14 shares characteristics from numerous previous embodiments. More particularly, this embodiment shares characteristics from the embodiment of FIG. 4 of the appended drawings. Except, now the front portion of the upper member 28, the pocket of the engagement feature 29, and the sole member 14 (not visible in FIG. 4) include at least the following: a power and data connector 50, a power and data line 48, a line connector 46, a memory source 44, a direct connection 40, and a battery (power source) 42.

In the embodiment of FIG. 14, the additional battery and additional memory source are built into the sole member 14 of the footwear in any suitable manner. I presently contemplate that the battery and memory source be located near the center of the sole member. However, any location of the battery and memory source can be suitable to benefit the consumer and/or manufacturer. The direct connection 40 is capable of directly recharging and inputting data to the additional battery and additional memory source. I presently contemplate that the direct connection uses an outside source such as a personal computer to recharge and input data to the housing. However, any outside source can be suitable to benefit the consumer and/or manufacturer. Moreover, the location of the direct connection can vary. For example, the direct connection can be desired on the upper member of the footwear to keep it free of dirt, liquids, and other environmental factors. Additionally, I presently contemplate that the direct connection includes a small rubber plug to keep out environmental factors. However, the plug can be made of any suitable material.

Furthermore, as illustrated, the embodiment of FIG. 14 includes a foot securing tongue 18 that connects to the upper member 28 proximate to the engagement feature 29. The foot-securing tongue 18, as described earlier, can be joined or removably joined to the upper member in any suitable manner known in the art, including, sewing, adhesives, fastener arrangements, etc. The foot securing tongue 18 can also take on characteristics of prior embodiments. More particularly, foot securing tongue 18 can take on characteristics of foot securing tongue 18A from the embodiment of FIG. 8.

The pocket of the engagement feature 29 can include, but is not limited to, characteristics of prior embodiments to engage a Pant-Leg-Cover. In the embodiment of FIG. 14 the sole member 14 includes the direct connection 40. The direct connection 40, as mentioned, is capable of transferring data and power to the battery 42 and memory source 44 from an outside source (e.g. personal computer). The battery and memory sources are capable of storing large amounts of power and data. The power and data line 48 is capable of transferring the power and data from the additional battery and memory source to the power and data connector 50. I presently contemplate that the power and data line is made of a conductive wire to transfer power and data. However, any materials can be used to increase the amount and speed of the data and power transferred (e.g. fiber optics, etc.).

Therefore, when the consumer desires, they can engage their Pant-Leg-Cover into the engagement feature 29 (operation of engagement described in previous embodiments). In doing so, the power and data connector 50 connects with a power and data connector located on the clip portion of the PLC. The connection provided between the at least two power and data connectors enables the consumer to transfer data and power. The power and data can be transferred from the housing to the PLC or vice versa. As a result, the consumer is provided with additional battery life and additional memory for their PLC. The PLC mentioned will be described in the following embodiment, "FIG. 15—PLC with Visual Display, Camera, and Synchronized Audio Speakers".

Figure 15:
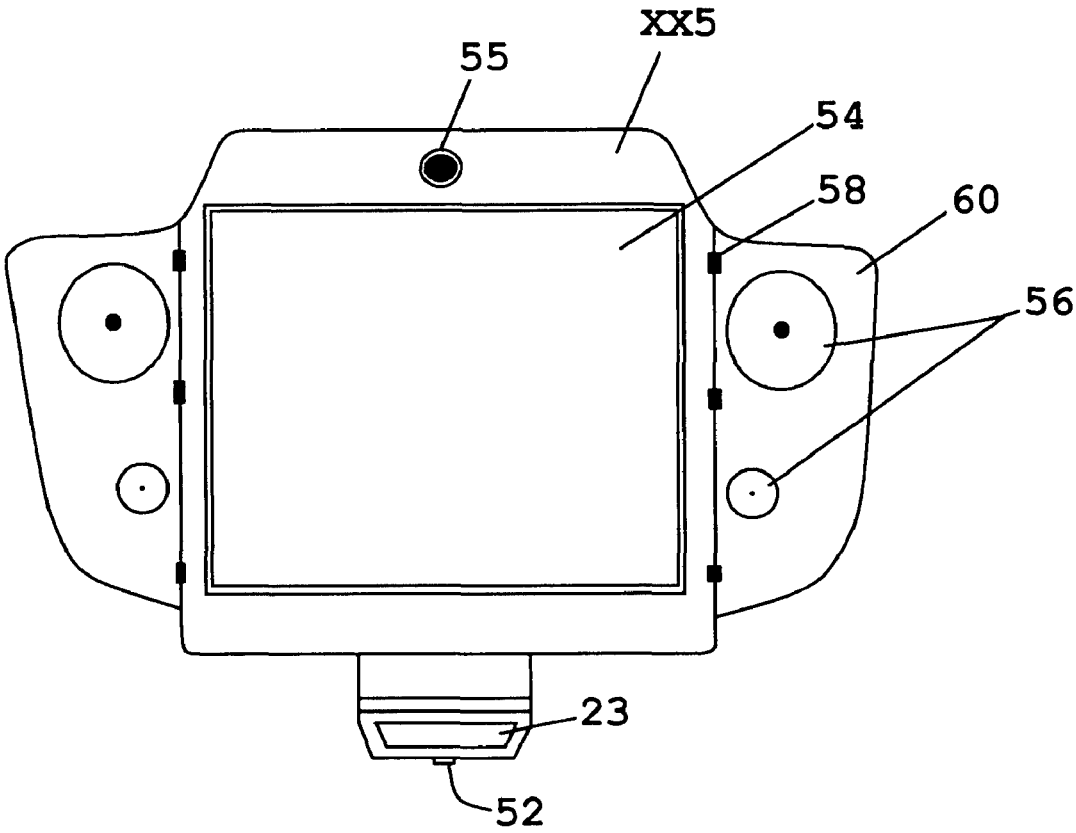
FIG. 15 is a front view of a PLC that includes a visual display, a camera, and synchronized audio speakers.

"FIG. 15—PLC with Visual Display, Camera, and Synchronized Audio Speakers" is a front view of PLC XX5. PLC XX5 includes a visual display 54, a camera 55, a couple sets of hinge-type mechanisms 58, a couple wing members 60, a set of synchronized audio speakers 56, a clip portion 23, and a data and power connector 52.

The visual display 54 can be removably joined to the PLC XX5 similar to the way that the compartment casings were joined to the PLC in the above figures. Therefore, additional power and data connectors can be present between the visual display and the PLC XX5. These power and data connectors can be quickly, easily, and efficiently connected and disconnected.

In the embodiment of FIG. 15, the synchronized audio speakers 56 are set off to the side of the visual display 54 on the wing members 60. In this embodiment, the wing members are joined to the PLC XX5 by the hinge-type mechanisms 58. However, the wing members 60 can be joined to the PLC XX5 in any suitable manner (e.g. sewing, adhesives, molding, fastener arrangements, etc.). The different manners will provide different advantages benefiting the consumer and/or manufacturer. The hinge-type mechanisms of this embodiment allow the wing members to form to the contour of the footwear.

Moreover, the synchronized audio speakers 56 are connected to play corresponding sound with the visual display. In the embodiment of FIG. 15, the synchronized audio speakers are visible to the surrounding environment. In turn, this increases the marketability potential of this particular embodiment. However, the synchronized audio speakers can be hidden, if desired.

Above the visual display is the camera 55 on PLC XX5 (FIG. 15). The camera can capture at least sill images and video of the surrounding environment. Therefore, the consumer can at least detach their PLC and record video by hand. The video can be saved on the PLC or in the additional memory source. Moreover, the video can be transferred to other outside sources (e.g. computer, television, phone, etc.) or replayed directly on the visual display 54. Additionally, the PLC can include conventional features that come with cameras.

The bottom portion of PLC XX5 includes the clip portion 23 and the data and power connector 52. The clip portion 23 engages with the engagement feature of the housing (described earlier), and joins the PLC XX5 with the footwear. When the PLC is engaged with the housing, the power and data connector 52 also engages with the corresponding power and data connector on the housing. As mentioned, the corresponding footwear includes the additional battery and the additional memory source. The additional battery and memory is transferred to the PLC XX5 using the power and data connectors. The power and data connector 52 can also directly connect to an outside source (e.g. personal computer, docking device).

It must be noted; as technology evolves so will the features and benefits of PLC XX5. Today, the PLC XX5 can include at least wireless interne or wireless data connections (e.g. Bluetooth technology). Also, the PLC can be a wireless phone including multiple functions, and capable of displaying the consumer's desires as well. The Pant-Leg-Cover can include multiple screens too.

Currently, I believe that the Pant-Leg-Cover will be best suited for displaying videos from the Internet. The videos can come from websites such as, YouTube, or other video websites: People can have videos of themselves, friends, family, music videos, the possibilities are endless. Today, many phones have access to the interne and consumers can view their videos by phone. However, these must be accessed by a phone. The phone must be kept in a pocket or garment when not in use. The Pant-Leg-Covers that include visual displays and synchronized audio speakers allow a consumer to constantly advertise their video. As a result, their footwear continually displays a priceless conversation piece, if so desired.

Relating to communication, humans are more comfortable starting conversations with someone that has a conversation piece. As a result, a consumer wearing modified footwear including the visual displays and synchronized audio speakers should expect to talk with others about the videos on their footwear. On days that the consumer does not want to interact with others (their mood changes), they can at least easily, efficiently, conveniently, and safely remove their PLC's including the visual displays and synchronized audio speakers. In turn, their footwear appears to be any conventional footwear, if so desired. Also, their PLC's can fold up or reduce in size to easily, conveniently, and temporarily store the PLC.

The reader must realize that a PLC will soon be more than just an interchangeable display for footwear. The Pant-Leg-Cover is in line to become more valuable than the underlying footwear to which the PLC is connected. It is no secret that footwear wears down with consumer use. The PLC on footwear is less susceptible to wear and tear. As a result, consumers can keep their PLC's for a longer period of time than their footwear. Since the PLC's are interchangeable, the consumer can quickly, efficiently, and conveniently interchange their PLC's to other, newer footwear. This saves the consumer from purchasing multiple visual displays with synchronized audio speakers.

Figure 16:
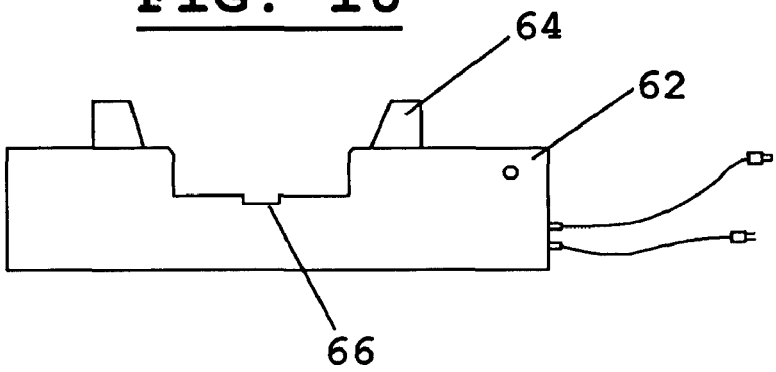
FIG. 16 is a front view of a docking device.

"FIG. 16—PLC Docking Device" is a front view of another embodiment. The embodiment includes a docking device 62. The docking device is used to hold a PLC including visual displays and synchronized audio speakers. A set of positioning members 64 are used to hold the PLC in an upright position. A power and data port 66 is used to transfer data and power to the power and data connector of the PLC. The docking device can connect with multiple outside sources (e.g. personal computers, power outlets, phones, etc.).

I presently believe that the docking device in FIG. 16 will be advantageous to the consumer. The reason is that the consumer can keep the device on their desk, at home, or wherever convenient. This docking device provides a consistent place where the consumer can transfer power and data to their PLC including visual displays and synchronized audio speakers. Also, the docking device is capable of holding the PLC in an upright position that is easily viewable and saves desk space.

Figure 17:
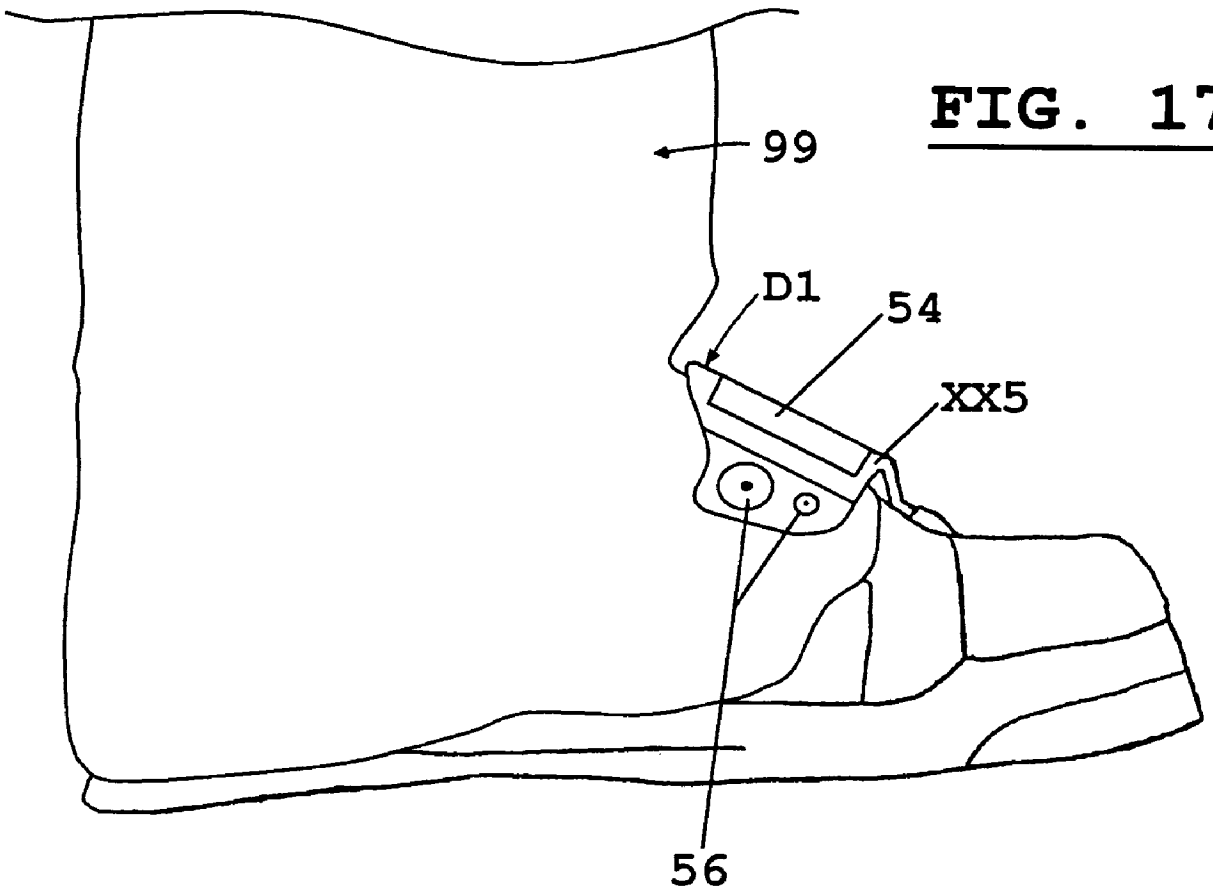
FIG. 17 is a right side view of a modified piece of footwear that has a PLC including a visual display, a camera, and a set of synchronized audio speakers.

"FIG. 17—Modified Footwear w/PLC XX5 and Pant Leg" is a side view of an embodiment. The embodiment of FIG. 17 includes features and characteristics from earlier Figures. As mentioned, the PLC XX5 includes the visual display 54 and the synchronized audio speakers 56. The free distal end D1 of PLC XX5 makes it possible for the pant leg 99 to be accommodated, secured, and utilized between the housing and the inside surface of the PLC (as discussed). The combination of features distinctive to the discussed embodiments creates a unique piece of modified footwear. The unique, modified footwear is capable of displaying at least visual images including synchronized audio sound above the long, loose-fitted pant leg of the consumer.

Advantages [FIGS. 13, 14, 15, 16, and 17]

Numerous advantages from the embodiments of FIGS. 13, 14, 15, 16, and 17 including interchangeable Pant-Leg-Covers with visual displays, cameras, and synchronized audio speakers become evident:

(A) The Pant-Leg-Covers including visual displays, cameras, and synchronized audio speakers do not directly touch the consumer/user's foot. Therefore, the PLC's can be stiff or flexible and not jeopardize the comfort of the consumer's foot. As a result, the PLC's can accommodate both stiffly and flexibly-backed visual displays.

(B) The PLC's can capture and save images from the surrounding environment (e.g. take pictures, video).

(C) The PLC's provide the manufacturer with additional options in producing differentiated visual displays. This enables the manufacturer to expand their product lines.

(D) The Pant-Leg-Covers including visual displays and synchronized audio speakers are visible when the consumer is wearing short pants.

(E) The Pant-Leg-Covers including visual displays and synchronized audio speakers are visible even when the consumer is wearing long, loose-fitted pant legs. This is a very important advantage. The reason, the consumer's pant leg will not cover any portion of their visual display.

(F) The consumer's pant leg acts as a contrasting background to the visual display and synchronized audio speakers. The contrasting background exponentially enhances the appearance of the consumer's PLC's.

(G) The enhanced visibility of the PLC's including visual displays and synchronized audio speakers greatly increase the marketability of the footwear.

(H) The Pant-Leg-Covers including visual displays and synchronized audio speakers provide a visual display with corresponding sound (music, voice, etc.). As a result, at least the consumer can see their visual images with the corresponding sound. This is very advantageous for any video or image that includes and/or needs corresponding sound data.

(I) Both the consumer/user and other people in the surrounding environment can conveniently view the Pant-Leg-Covers including visual displays and synchronized audio speakers.

(J) The PLC's including visual displays and synchronized audio speakers are easily, conveniently, quickly, and safely interchangeable and/or removable from the housing of the foot-receiving apparatus. This is advantageous when the PLC's are not desired.

(K) Additional Advantages of being interchangeable and/or removable

1. The Pant-Leg-Covers including visual displays and synchronized audio speakers can be used as a hand-held device.
2. When the Pant-Leg-Covers including visual displays and synchronized audio speakers are detached, the consumer can bring it closer to their face. This makes it easy and convenient for the consumer to see their display. This also reduces the strain on their eyes. The reason is that the visual display and synchronized audio speakers can be held in their hand, at a proper angle, rather than inconveniently on their foot.
3. When the Pant-Leg-Covers including visual displays and synchronized audio speakers are detached, the consumer is free to pass the Pant-Leg-Covers around to friends and family so they can also receive a convenient view. This is advantageous over passing around an entire piece of footwear that can be dirty, oddly shaped, smelly, etc.
4. When the Pant-Leg-Covers including visual displays and synchronized audio speakers are detached, the footwear can appear to be any conventional footwear.
5. If the consumer is outside and rain, sleet, snow, or bad weather begins unexpectedly; the consumer can quickly, easily, conveniently, and safely remove their Pant-Leg-Covers. At the same time, the consumer can seal or plug the pockets of their electrical engagement features. This avoids potential damage to the electronic components.
6. The consumer is able to easily and efficiently reduce the size of the Pant-Leg-Covers. This is advantageous when the visual displays and synchronized audio speakers are not desired by the consumer. They can do so by at least folding in the synchronized audio speakers. As a result, the PLC's are able to conveniently fit in at least a pocket of the consumer.
7. Public schools can prohibit the use of visual displays including synchronized audio speakers. Therefore, consumers are able to detach their Pant-Leg-Covers and leave them at home. This enables the consumer to still wear their favorite footwear without substituting other footwear. Additionally, the footwear appears to be conventional footwear, so there is not a big spot (fastener arrangement) where something is missing on the footwear. This footwear will not distract teachers, the young consumer, or fellow students in their delivery or advancement in education.
8. When removed from the foot-receiving apparatus, the PLC's including visual displays and synchronized audio speakers can be connected to a docking device to upload data or recharge battery-life. This provides a quick, clean, and convenient way for the consumer to at least update and recharge their Pant-Leg-Covers.
9. When removed from the foot-receiving apparatus, the Pant-Leg-Covers including visual displays and synchronized audio speakers can be connected directly to at least a personal computer to at least upload data and recharge battery-life.

(L) The Pant-Leg-Covers including visual displays and synchronized audio speakers contain their own battery separate of the footwear. Therefore, it is possible for the consumer to keep watching and listening to their visual display without it being connected to the footwear.

(M) The Pant-Leg-Cover keeps the visual display, battery, audio speakers, etc. on a single hand-held piece of material that is detachable to the wearable footwear. This greatly increases consumer convenience when the Pant-Leg-Covers are detached and at least passed around to friends and family.

(N) The footwear contains additional batteries that recharge the Pant-Leg-Covers including the visual display and synchronized audio speakers. Therefore, if the consumer uses up the battery-life included within their Pant-Leg-Covers, it is not a problem. The consumer can simply and conveniently engage the Pant-Leg-Cover with the footwear and receive a needed charge. This is particularly advantageous for a consumer that is traveling and has no convenient way to recharge their Pant-Leg-Covers.

(O) The Pant-Leg-Covers including visual displays and synchronized audio speakers include a headphone port. This is advantageous when the loud speakers are not desired.

(P) The Pant-Leg-Covers including visual displays and synchronized audio speakers include multiple function buttons capable of controlling the following, but are not limited to: mute, zoom, contrast, volume, brightness, etc.

(Q) The visual displays can be interchanged to different Pant-Leg-Covers. In other words, different Pant-Leg-Covers are capable of interchanging and receiving different visual displays. This is advantageous to consumers if multiple electronic corporations are providing different visual displays at various prices.

(R) The Pant-leg-Covers can include sealable casings around the visual displays and marine speakers. This is advantageous since footwear is susceptible to water, dirt, and various other environmental factors.

(S) The Pant-Leg-Covers including visual displays and synchronized audio speakers can include a customizable lens or display cap. This cap or covering can be desirable at certain times when the visual display is not desired and is not removed.

(T) The borders of the Pant-Leg-Covers are capable of being customized by at least the consumer.

(U) The PLC's including visual displays and synchronized audio speakers are always viewable, if desired. This provides a priceless conversation piece.

(V) The advertisements that are shown on the visual displays can be verbally reinforced by the consumer. This increases the effectiveness of the advertisement on the recipient.

Figure 18:
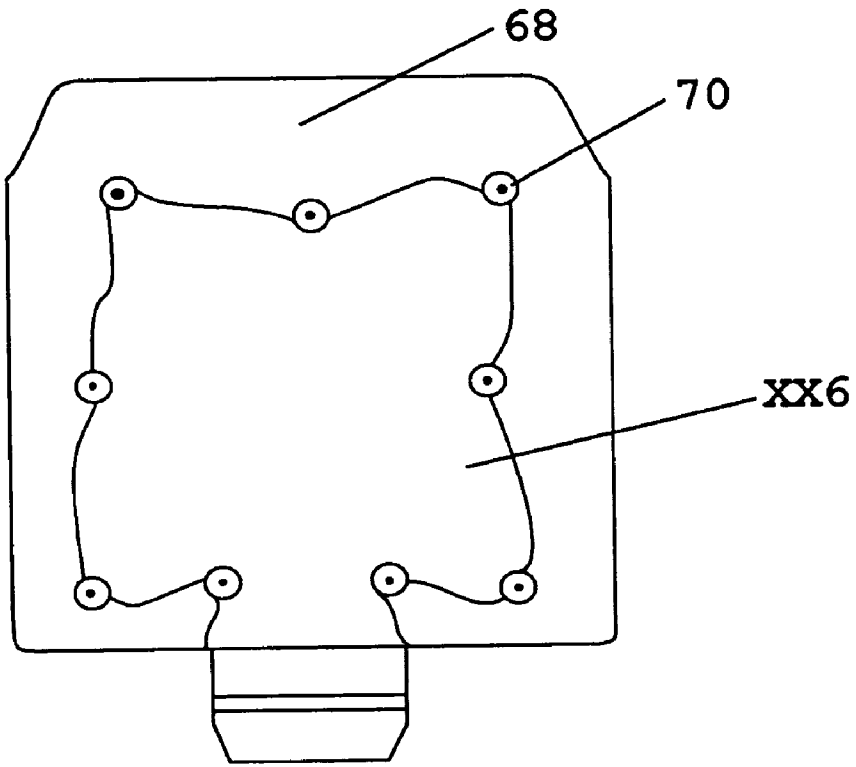
FIG. 18 is a back view of a PLC that includes an additional decorative cover member.

"FIG. 18—Additional Decorative Cover Member" illustrates a back view of a PLC XX6. An additional decorative cover member 68 wraps around to the back of the PLC. On the back of the PLC, the additional decorative cover member joins to the back surface of the PLC by a plurality of button fasteners 70. However, any type of fastener arrangement can be used to join the additional decorative cover member with the PLC. For example, the additional decorative cover member can use a set of elastic members to join to the PLC.

I presently contemplate that the additional decorative cover member (FIG. 18) be one-sided. However, other embodiments can include additional decorative cover members that are double sided, reversible, or a combination thereof. Furthermore, I presently contemplate that the additional decorative cover members be made of a cloth-like material. However, any material can be suitable to provide various advantages. The various advantages can at least benefit the consumer and/or manufacturer. Also noteworthy; the consumer can customize their additional decorative cover members in any manner discussed throughout this specification.

The additional decorative cover members (FIG. 18) provide an excellent, cost effective way for the consumer to at least change the appearance of their Pant-Leg-Cover. As discussed earlier, the additional decorative cover members can include Trademarks and Copyrights. At concerts, artists will be able to sell their own personalized additional decorative cover members to consumers. This provides a quick, easy, and efficient way for consumers to change the appearance of their PLC's. As a result, the consumer can change the appearance of their PLC instantaneously at the concert. The manufacturer, and/or consumer, can use any method, or discussed method to change the appearance of the additional decorative cover members. The various methods will increase product differentiation and benefit at least the consumer and/or manufacturer. The various methods can be similar to changing the appearance of Pant-Leg-Covers.

Figure 19:
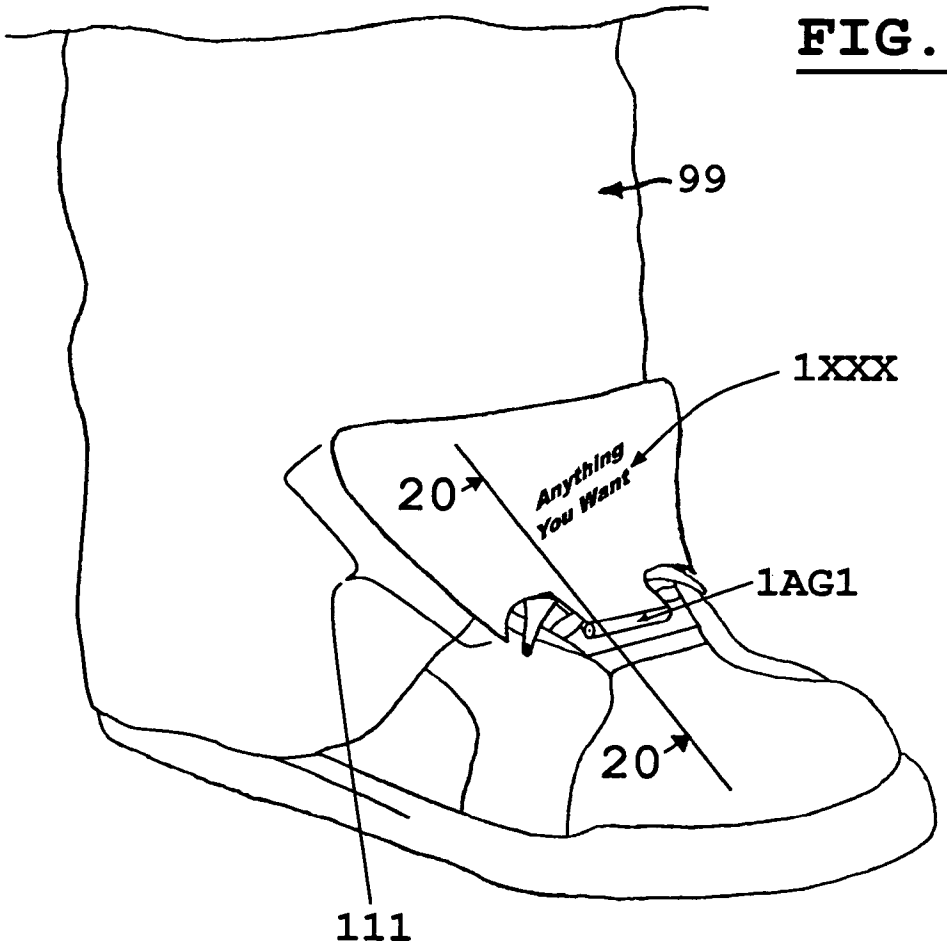
FIG. 19 is a front right view of a piece of conventional footwear including an interchangeable PLC removably joined to the housing.

"FIG. 19—Conventional Footwear with Pant-Leg-Covers" illustrates a front right view of another embodiment. In the embodiment of FIG. 19, a PLC 1XXX is removably joined to the housing of the conventional footwear. The PLC of FIG. 19 shares characteristics with Pant-Leg-Covers from previous embodiments. The PLC 1XXX includes an adjustment mechanism 1AG1. The adjustment mechanism 1AG1 operates similarly to the adjustment mechanism of FIG. 9 in the appended drawings. Again, as illustrated, the PLC is able to substantially accommodate the long, loose-fitted pant leg 99. The pant leg 99 is also utilized as a contrasting background to the PLC. For example, the substantial length of space 111 is able to at least accommodate, secure, and utilize the pant leg 99 of the consumer more than 50% of the way down the inside surface of the PLC. The benefits of the PLC are identical to those of the PLC's described in previous Figures. However, this PLC is able to join and removably join to any conventional footwear. As a result, this PLC is an alternative to purchasing modified footwear.

Again, this specific example of Pant-Leg-Cover 1XXX (FIG. 19) allows for a consumer to substantially utilize a pant leg and increase the marketability of their footwear even if their footwear is not modified. This type of PLC will appeal to people who already own non-modified footwear. Another advantage to this particular embodiment is that it is cost effective. Rather than buying completely new footwear, a consumer can attach PLC 1XXX to footwear they already own. Thus, they can still enjoy the benefits of modified footwear.

In the same manner, PLC 1XXX (FIG. 19) is advantageous for a corporation too. This allows for a corporation to expand their product line. It also provides product differentiation within the corporation's line of PLC's. In effect, this particular embodiment is advantageous for the consumer and the corporation selling the product. This embodiment of a removable PLC can be joined, or removably joined, and transferred to any particular foot-receiving apparatus; it can also attach to any numerous portions of the apparatus in a variety of ways or methods. For example, the removable Pant-Leg-Cover of FIG. 19 can be located on the outboard side of the foot-receiving apparatus and can be removably joined to the footwear in any suitable manner.

Figure 20:
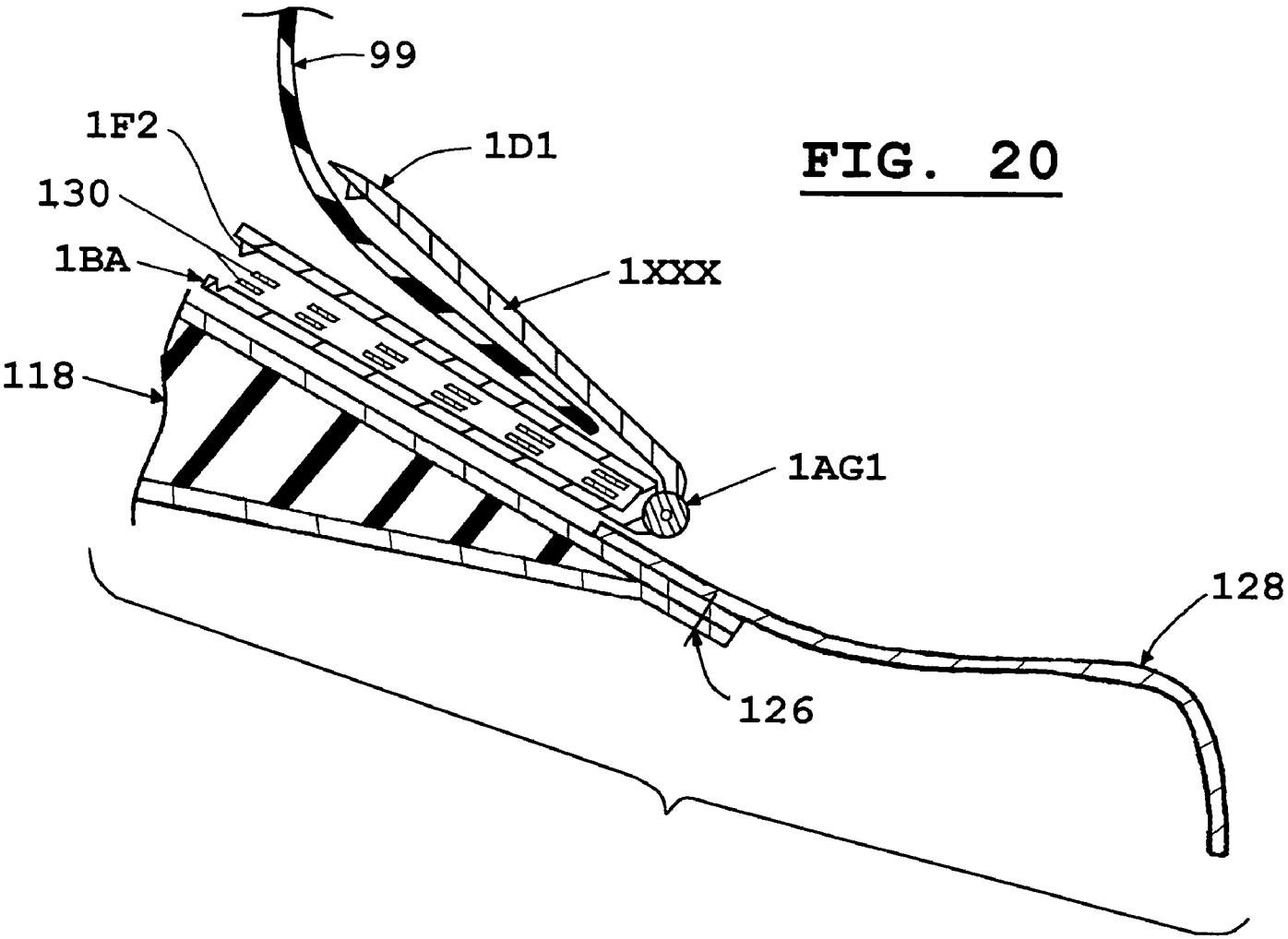
FIG. 20 is a side sectional view taken along line 20-20 of FIG. 19.

"FIG. 20—PLC for Conventional Footwear, Side Section" is a side sectional view taken along line 20-20 of FIG. 19. This particular embodiment illustrates a foot-securing tongue 118 joined to a front portion of the upper member 128 at a point 126. A set of lace-securing members 130 are used to connect the PLC 1XXX to the housing. PLC 1XXX is joined to lace-securing members 130 by a Pant-Leg-Cover attachment 1BA. The PLC attachment 1BA opens away from adjustment mechanism 1AG1 to contain lace-securing members 130.

A fastener arrangement 1F2 (FIG. 20) is located on the ends of PLC attachment 1BA. The fastener arrangement connects the ends of the PLC attachment. As a result, the PLC attachment is secured around the lace-securing members 130. This joins the PLC 1XXX to the housing. Multiple PLC's can be developed to connect with, or adjoin to, a variety of areas on foot-receiving apparatuses.

Moreover, PLC 1XXX (FIG. 20) has a free upper portion 1D1. The free upper portion provides the substantial length of space to at least accommodate, secure, and utilize the pant leg 99. The inside surface of the free upper portion can also include a fastener arrangement to secure the pant leg. In turn, the utilization of pant leg 99 at least keeps the pant leg in a clean, comfortable, fashionable, and safe position.

Figure 21:
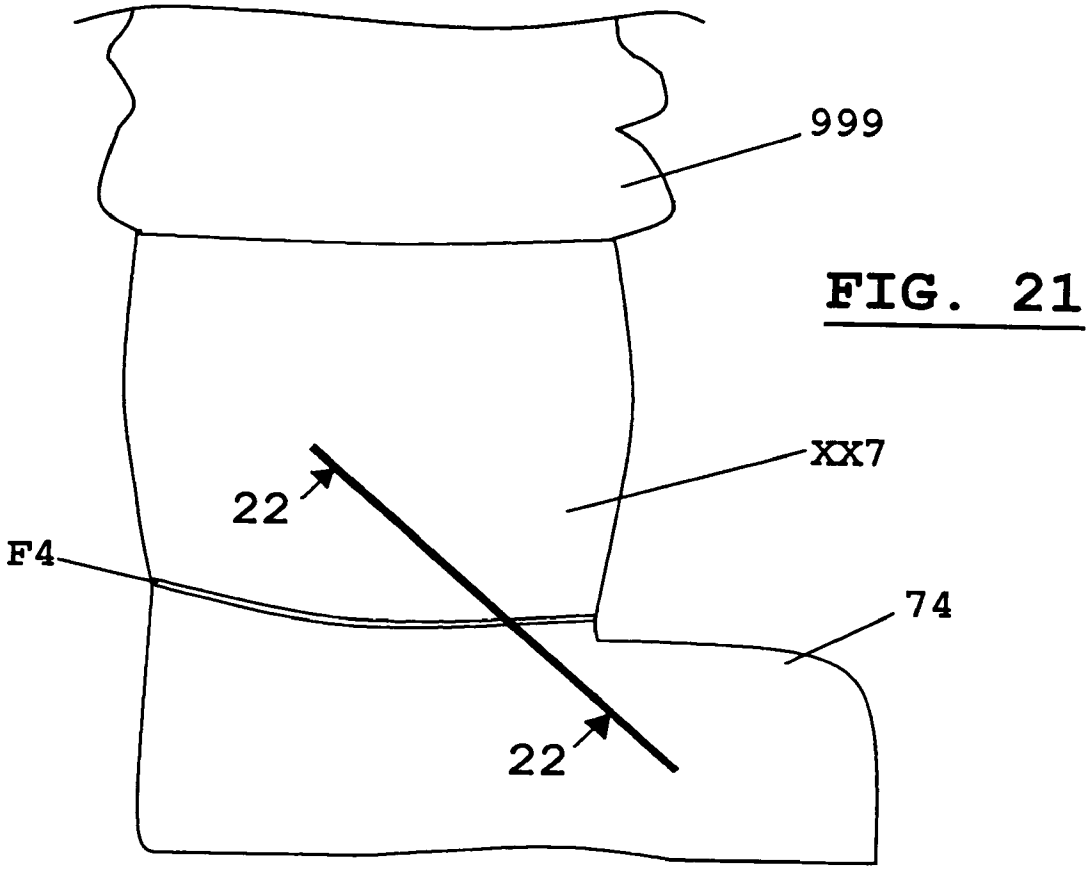
FIG. 21 is a right side view of a boot that includes a PLC.

"FIG. 21—Boot including PLC" is a right side view of another embodiment. The embodiment of FIG. 21 includes a winter pant leg 999, a PLC XX7, a fastener arrangement F4, and a housing 74. The illustration is not intended to include all possible aspects of winter boots. Yet, all aspects of winter boots are not out of the scope of the invention (e.g. comfort members, insulation, waterproof material, etc.) The winter pant leg 999 is similar to a warm suit worn by many hunters in the dead of winter. These large, warm suits often times hang over the side of the hunters (consumers) boot. This poses problems.

Hunters can walk through swaps and creeks while wearing their boots. Thus, when their winter pant leg is outside their boot, it is prone to get wet. After the hunter sits in the cold, their pant leg can get frozen and lead to potentially dangerous effects (e.g. hypothermia, frost bite, etc.) As a result, hunters (much like other consumers) are forced to jam-up or bunch-up their winter pant leg between their boot and their body. Again, this is proven uncomfortable and often times in effective (e.g. pant leg returns to covering the outside of the hunter's boot). Accordingly, embodiments will at least solve this problem.

I presently contemplate that the PLC XX7 of FIG. 21 is removably joined at the fastener arrangement F4. However, the PLC can be fixedly joined to the housing 74. Also, the PLC can be joined to the housing at any portion and in any manner. For example, the fastener arrangement F4 can be a waterproof arrangement. The various locations and manners of joining the PLC's will at least benefit the consumer and/or manufacturer.

Additionally, hunters are able to hunt in different environments. These environments often times require different types of camouflage. In turn, many hunters are forced to buy numerous pairs of boots to match the environment they are hunting. The PLC XX7 of FIG. 21 is able to be customized to the hunter's unique desires. It can be customized in any manner similar to the Pant-Leg-Covers of previous embodiments. Therefore, a hunter can have a single pair of boots that can appear to match multiple environments. This is a great advantage to a hunter's pocket book.

Figure 22:
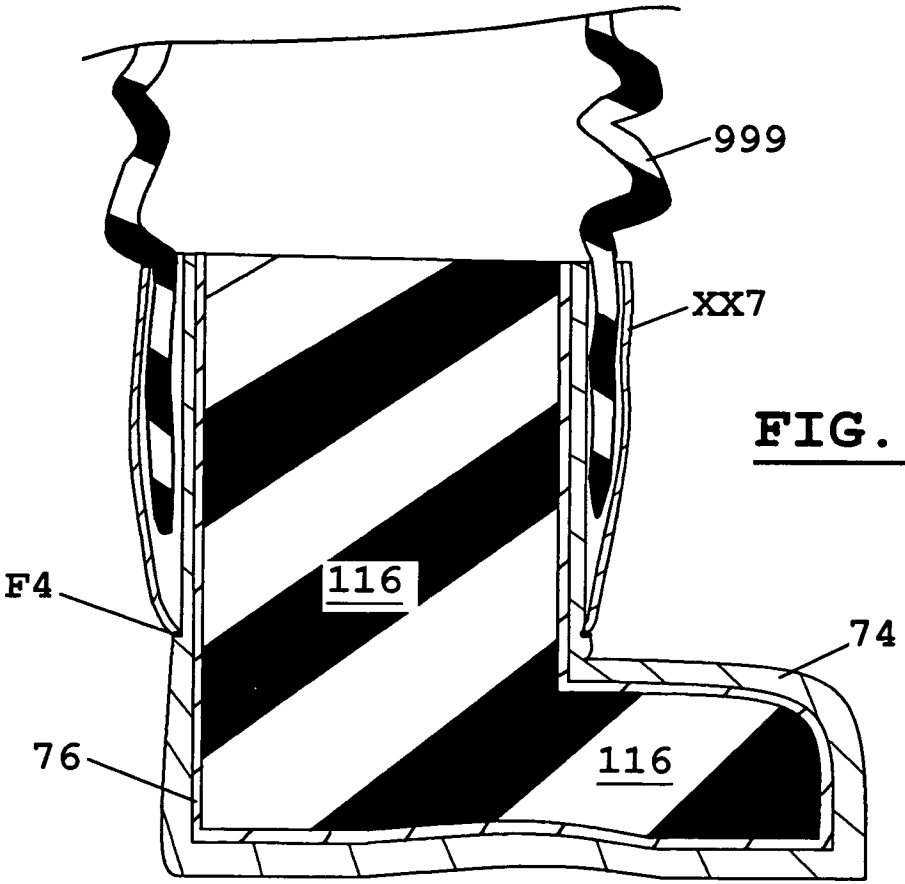
FIG. 22 is a side sectional view taken along line 22-22 of FIG. 22.

"FIG. 22—Boot including PLC, Side Section" is a side sectional view taken along line 22-22 of FIG. 21. The embodiment of FIG. 22 includes the winter pant leg 999, the PLC XX7, the fastener arrangement F4, the housing 74, a boot liner 76, and an interior 116. The hunter's foot is received in the interior 116 in a conventional way. The hunter's foot is insulated by at least the boot liner 76. Outside of the boot liner is the housing 74. Outside of the housing is where the PLC XX7 creates a substantial amount of space to at least accommodate, secure, and utilize the winter pant leg 999. Again, the PLC can join to the housing at any, portion and in any manner.

D. CONCLUSION

The Pant-Leg-Cover can be composed of any variety of materials, some of which are mentioned in this specification. The different materials provide different advantages to benefit at least the consumer and/or manufacturer. From satisfying personal taste to fitting the contour of the shoe, the material that the Pant-Leg-Cover is composed of plays an integral role in at least the construction, method of manufacture, marketability, sale, and profit of the footwear. Additionally to materials, the combinations and sub-combinations of interchangeable and affixed Pant-Leg-Covers will also help to differentiate product lines. Product differentiation allows a corporation to appeal to more potential consumers.

In brief financial terms, Pant-Leg-Covers at least increase the marketability of foot-receiving apparatuses; multiple marketability aspects lead to increased sales; increased sales lead to profit growth; profit growth expands shareholder value. This specification describes some of the advantages of Pant-Leg-Covers that utilize pant legs to create a sustainable competitive advantage for a select corporation.

Various embodiments of the present invention have been described above, and it will be understood by those of ordinary skill that the present invention includes within its scope all combinations and sub-combinations of these various embodiments. Thus, the reader will see that at least one embodiment of the Pant-Leg-Cover provides at least a more visible, expressive, secure, clean, comfortable, easily usable, fashionable, safe, yet economically feasible portion of footwear that can be used by persons of almost any age.

It is not intended herein to mention all of the possible equivalent forms or ramifications of the present invention (e.g. adding basic functions to the Pant-Leg-Covers, foot-receiving apparatuses, and pant legs, such as but not limited to: pockets, containers, removable display cover members, safety features, varied displays, casing adjustments, multiple displays, magnets, different materials, glow-in-the dark features, waterproof materials, fixedly joined electronic displays, different fastening arrangements, synchronized visual displays, and the like). The embodiments mentioned herein are not intended to mention all possible embodiments that can or will sell to potential consumers. For example, modified footwear including Pant-Leg-Covers where additional modifications are made to portions of the footwear housing. Other examples include: a Pant-Leg-Cover that is reversible (indicia on all sides), is washer or dishwasher safe, changes color with temperature, has a fold over flap, has removable portions, extendable portions, etc. It is understood that the terms used herein are merely descriptive rather than limiting, and various changes can be made without departing from the spirit or scope of the present invention, as described in the appended claims and based throughout this specification. Again, the above are merely illustrations, not limitations.

COMPONENTS OF EMBODIMENTS

| FIG. 1 | |
|---|---|
| 12 | Upper member |
| 14 | Sole member |
| 11 | Substantial length of space |
| 13 | Substantial length of space |
| 15 | Substantial length of space |
| 16 | Interior of the housing |
| 18 | Foot-securing tongue |
| 28 | Front portion of upper member |
| 30 | Lace-securing members |
| 30 & 18 = | Closure device |
| XX1 | Pant-Leg-Cover (PLC) (at instep) |
| XX2 | PLC (at heel) |
| XX3 | PLC (at outboard side) |
| A1 | Fixable lower portion PLC XX1 |
| A2 | Fixable lower portion PLC XX2 |
| A3 | Fixable lower portion PLC XX3 |
| D1 | Free upper portion of PLC XX1 |
| D2 | Free upper portion of PLC XX2 |
| D3 | Free upper portion of PLC XX3 |
| FIG. 2 | |
| XX1 | Pant-Leg-Cover (PLC) (at instep) |
| XX2 | PLC (at heel) |
| XX3 | PLC (at outboard side) |
| 99 | Pant leg |
| 11 | Substantial length of space |

-continued

| COMPONENTS OF EMBODIMENTS | |
|---|---|
| 13 | Substantial length of space |
| 15 | Substantial length of space |
| | FIG. 3 |
| XX1 | Pant-Leg-Cover (PLC) (at instep) |
| XX2 | PLC (at heel) |
| XX3 | PLC (at outboard side) |
| 99 | Pant leg |
| 28 | Front portion of upper member |
| 28A | Retainer arm |
| | FIG. 4 |
| XX1 | Pant-Leg-Cover (PLC) (at instep) |
| D1 | Free upper portion of PLC XX1 |
| F1 | Fastener arrangement |
| 18 | Foot-securing tongue |
| 23 | Clip portion (flexible projection) |
| 26 | Point/Location (possible fastener arrangement) |
| 28 | Front portion of upper member |
| 28A | Retainer Arm (extension of 28) |
| 29 | Engagement Feature |
| 30 | Lace-securing members |
| 99 | Pant leg |
| | FIG. 5 |
| XX2 | PLC (at heel) |
| A2 | Fixable lower portion PLC XX2 |
| D2 | Free upper portion of PLC XX2 |
| 12 | Upper member |
| 14 | Sole member |
| 99 | Pant leg |
| | FIG. 6 |
| XX3 | PLC (at outboard side) |
| A3 | Fixable lower portion PLC XX3 |
| D3 | Free upper portion of PLC XX3 |
| 12 | Upper member |
| 16 | Interior of the housing |
| 23AA | Clip portion |
| 29AA | Engagement feature |
| 99 | Pant leg |
| | FIG. 7 |
| 1XX1 | PLC |
| 1F2 | Fastener arrangement |
| S-1A | Surface portion |
| 112 | Upper member |
| 128 | Front portion upper member |
| 128A | Retainer arm |
| 130 | Lace-securing members |
| 199 | Pant Leg |
| | FIG. 8 |
| 1XX1 | PLC |
| 1F1 | Fastener Arrangement |
| 123 | Clip portion |
| 128 | Front portion upper member |
| 128A | Retainer arm |
| 129 | Engagement feature |
| 199 | Pant Leg |
| 18A | Modified Tongue |
| S-1A | Surface portion |
| S-1C | Surface portion |
| 1A | Top portion |
| 1B | Middle portion |
| 1C | Bottom portion |
| 1F3 | Fastener arrangement |
| 126A | Point/fastener arrangement |
| 130 | Lace-securing members |
| | FIG. 9 |
| AG1 | Adjustment mechanism |
| P1 | Position 1 |
| P2 | Position 2 |

-continued

| COMPONENTS OF EMBODIMENTS | |
|---|---|
| P3 | Position 3 |
| | FIG. 10 |
| XX4 | PLC |
| C1 | Compartment casing |
| | FIG. 11 |
| XX4 | PLC |
| C1 | Compartment casing |
| C2 | Compartment casing |
| B1 | Built-in button |
| SP | Speaker port |
| 44 | Seal member |
| | FIG. 12 |
| XX4 | PLC |
| C2 | Compartment casing |
| B1 | Built-in button |
| SP | Speaker port |
| 41 | Fastener arrangements |
| | FIG. 13 |
| 14 | Bottom sole member |
| 99 | Pant leg |
| | FIG. 14 |
| 14 | Bottom sole member |
| 16 | Interior |
| 18 | Foot securing tongue |
| 28 | Front portion upper member |
| 29 | Engagement feature |
| 40 | Direct connection |
| 42 | Battery (power source) |
| 44 | Memory source |
| 46 | Line connector |
| 48 | Power/data line |
| 50 | Power/data connector |
| 99 | Pant leg |
| | FIG. 15 |
| XX5 | PLC |
| 23 | Clip portion |
| 52 | Power/data connector (PLC) |
| 54 | Visual Display |
| 55 | Camera |
| 56 | Synchronized audio speakers |
| 58 | Hinge-type mechanism |
| 60 | Wing member |
| | FIG. 16 |
| 62 | Docking device |
| 64 | Positioning member |
| 66 | Power/data port |
| | FIG. 17 |
| XX5 | PLC |
| D1 | Free upper portion |
| 54 | Visual Display |
| 56 | Synchronized audio speakers |
| 99 | Pant leg |
| | FIG. 18 |
| XX6 | PLC |
| 68 | Additional decorative cover |
| 70 | Button fasteners |
| | FIG. 19 |
| 1XXX | PLC |
| 2XXX | PLC |
| 1AG1 | Adjustment mechanism |
| 99 | Pant leg |
| 111 | Substantial length of space |
| | FIG. 20 |
| 1XXX | PLC |
| 1AG1 | Adjustment mechanism |
| 1D1 | Free upper portion |
| 1F2 | Fastener arrangement |

-continued

| COMPONENTS OF EMBODIMENTS | |
|---|---|
| 1BA | PLC attachment |
| 118 | Foot securing tongue |
| 126 | Point/Fastener arrangement |
| 128 | Front portion upper member |
| 130 | Lace-securing members |
| 99 | Pant leg |
| | FIG. 21 |
| 2XXX | PLC |
| 1A3 | Fixable lower portion |
| 1D3 | Free upper portion |
| 112 | Upper member |
| 123AA | long hook mechanism |
| 99 | Pant leg |
| | FIG. 22 |
| XX7 | PLC |
| F4 | Fastener arrangement |
| 74 | Housing |
| 999 | Winter pant leg |
| | FIG. 23 |
| XX7 | PLC |
| F4 | Fastener arrangement |
| 74 | Housing |
| 76 | Boot liner |
| 116 | Interior |
| 999 | Winter pant leg |

I claim:

1. A customizable foot-receiving apparatus comprising:

a housing at least partially defining an interior, and having an external periphery and at least one engagement feature; and at least one interchangeable pant leg cover to customize the housing and being disposed substantially outside of the external periphery of the housing, and extending upwardly from a fixable lower portion to a free upper portion movable relative to the housing, wherein the fixable lower portion includes an engagement feature removably engageable with the at least one engagement feature of the housing;

wherein the housing includes a sole, an upper carried by the sole, a tongue carried by the upper to provide accessibility to the interior, and a closure device carried by the upper and extending over the tongue to close the apparatus, wherein the external periphery is at least partially defined by outer surfaces of at least one of the sole, upper, tongue, or closure device;

wherein the fixable lower portion of the pant leg cover is removably joined to the housing at an instep portion of the upper; and wherein the engagement feature of the at least one interchangeable pant leg cover includes a body and a flexible projection extending from the body, and the at least one engagement feature of the housing includes a pocket for receiving the body and a retainer arm to retain the flexible projection.

2. The customizable foot-receiving apparatus of claim 1, wherein the free upper portion is movable away from the housing to accept a portion of a pant leg between the at least one interchangeable pant leg cover and the housing.

3. The customizable foot-receiving apparatus of claim 1, wherein the at least one engagement feature of the housing includes at least one of a clip or a hook-and-loop fastener, and the engagement feature of the at least one interchangeable pant leg cover includes at least one of a clip or a hook-and-loop fastener corresponding to the at least one engagement feature of the housing.

4. The customizable foot-receiving apparatus of claim 1, wherein the housing includes an upper having an instep portion including a tongue, and the at least one engagement feature of the housing is carried by the instep portion at a base of the tongue.

5. The customizable foot-receiving apparatus of claim 1, wherein the at least one interchangeable pant leg cover includes an adjustment mechanism to enable a portion of the at least one interchangeable pant leg cover to be pivoted with respect to another portion of the at least one interchangeable pant leg cover.

6. The customizable foot-receiving apparatus of claim 1, wherein the fixable lower portion of the at least one interchangeable pant leg cover is joined to the housing at an outboard side of the apparatus.

7. The customizable foot-receiving apparatus of claim 6, wherein the at least one interchangeable pant leg cover is removably joined to the sole.

8. The customizable foot-receiving apparatus of claim 1, wherein the fixable lower portion of the at least one interchangeable pant leg cover is carried by the housing at a heel portion of the apparatus.

9. The customizable foot-receiving apparatus of claim 8, wherein the at least one interchangeable pant leg cover is joined to the upper at the heel portion.

10. The customizable foot-receiving apparatus of claim 1, wherein the at least one interchangeable pant leg cover includes decorative ornamentation.

11. The customizable foot-receiving apparatus of claim 10, wherein the decorative ornamentation includes at least one of a slogan, logo, quotation, or Copyrightable subject matter.

12. The customizable foot-receiving apparatus of claim 1, wherein the at least one interchangeable pant leg cover includes an inside surface and a pant leg engagement feature extending therefrom.

13. The customizable foot-receiving apparatus of claim 1, wherein the at least one interchangeable pant leg cover includes a lower portion including the fixable lower end, an upper portion including the free upper end, and an adjustment device therebetween to enable adjustment of the upper portion relative to the lower portion.

14. The customizable foot-receiving apparatus of claim 1, wherein the at least one interchangeable pant leg cover carries at least one of an electronic device, video display, or photograph.

15. The customizable foot-receiving apparatus of claim 14, wherein the at least one interchangeable pant leg cover includes a casing to carry the at least one of an electronic device, video display, or photograph.

16. The customizable foot-receiving apparatus of claim 1, wherein the at least one interchangeable pant leg cover is composed of a rigid material to enable the at least one interchangeable pant leg cover to maintain an upright position.

* * * * *